US009605494B2

(12) United States Patent
Hanton et al.

(10) Patent No.: US 9,605,494 B2
(45) Date of Patent: Mar. 28, 2017

(54) TOOL FOR SELECTIVELY CONNECTING OR DISCONNECTING COMPONENTS OF A DOWNHOLE WORKSTRING

(71) Applicant: TERCEL IP LTD., Road Town-Tortola (VG)

(72) Inventors: John Hanton, Aberdeen (GB); Jeffrey B. Lasater, Houston, TX (US)

(73) Assignee: Tercel IP Ltd., Road Town, Tortola (VG)

( * ) Notice: Subject to any disclaimer, the term of this patent is extended or adjusted under 35 U.S.C. 154(b) by 0 days.

(21) Appl. No.: 14/775,762

(22) PCT Filed: Mar. 15, 2013

(86) PCT No.: PCT/IB2013/000398
§ 371 (c)(1),
(2) Date: Sep. 14, 2015

(87) PCT Pub. No.: WO2014/140658
PCT Pub. Date: Sep. 18, 2014

(65) Prior Publication Data

US 2016/0024858 A1 Jan. 28, 2016

(51) Int. Cl.
*E21B 17/06* (2006.01)
*E21B 23/01* (2006.01)

(52) U.S. Cl.
CPC ..... *E21B 17/06* (2013.01); *E21B 23/01* (2013.01)

(58) Field of Classification Search
CPC ..... E21B 17/06; E21B 23/01
See application file for complete search history.

(56) References Cited

U.S. PATENT DOCUMENTS 1,544,890 A * 7/1925 Crippen ..... E21B 17/06 285/36
1,759,337 A * 5/1930 Zublin ..... E21B 17/06 285/330
2,049,289 A * 7/1936 Burns ..... E21B 17/06 285/106
2,202,261 A * 5/1940 Osmun ..... E21B 17/06 285/81
4,408,485 A * 10/1983 McGill ..... E21B 17/021 166/237

(Continued)

FOREIGN PATENT DOCUMENTS

CA 2265709 C * 4/2006 ..... E21B 17/06
GB 2500185 A 9/2013

OTHER PUBLICATIONS

PCT Search Report (PCT/IB2013/000398), dated Dec. 5, 2013.

*Primary Examiner* — James G Sayre
(74) *Attorney, Agent, or Firm* — Lloyd L. Davis; Andrews Kurth Kenyon LLP

(57) ABSTRACT

The present invention relates to a tool for selectively connecting or disconnecting components of a downhole workstring comprising a drive shaft (3) and a housing couplable to said drive shaft, and housing comprising first and second housing parts (21, 22) releasably connected to one another, transmission means such as a reduction gear mechanism (52-54) coupled to the drive shaft, the transmission means being arranged to selectively connect or disconnect the housing parts by rotating the drive shaft.

28 Claims, 8 Drawing Sheets

(56) References Cited

U.S. PATENT DOCUMENTS

| | | | | |
|---|---|---|---|---|
| 6,450,541 | B1 * | 9/2002 | Bakke | E21B 17/06 285/2 |
| 6,712,146 | B2 * | 3/2004 | Estep | E21B 17/06 166/242.6 |
| 2002/0000320 | A1 * | 1/2002 | Gissler | E21B 17/023 166/340 |
| 2012/0186826 | A1 * | 7/2012 | Le Briere | E21B 17/06 166/377 |
| 2014/0262342 | A1 * | 9/2014 | Obrejanu | E21B 33/0415 166/382 |

* cited by examiner

TOOL FOR SELECTIVELY CONNECTING OR DISCONNECTING COMPONENTS OF A DOWNHOLE WORKSTRING

CROSS-REFERENCE TO RELATED APPLICATIONS

This application is a 371 national phase application of PCT/IB2016/000398, filed Mar. 15, 2013.

BACKGROUND OF THE INVENTION

The present invention relates to the field of oil and gas exploration, and in particular downhole activities, such as, for example, drilling, logging, fishing, completions, etc.

More specifically, the present invention relates to a tool for selectively connecting or disconnecting components of a downhole workstring, comprising a drive shaft and a housing couplable to said drive shaft, said housing comprising a first housing part and a second housing part releasably connected to one another. In particular the invention is a so-called back off sub for release and re-connection of components of a downhole workstring.

Safety subs, also referred to in the industry as back-off safety subs (BOSS), are used in downhole activities to disengage or connect components of downhole string whenever it becomes necessary. This tool is used in various workstrings such as drill, fishing, washover string. During normal downhole activities, the tool transmits torque from the upper string to the equipment below the tool. Disconnection may for example be required to recover the part of the string above the equipment which has been or stuck or otherwise fixed downhole.

Some known safety subs comprise upper and lower mating parts couplable together by way of a thread and a stop device for preventing the thread from loosening until it is required to disengage the mating parts. Such a stop device can comprise a spring or a friction ring or some other stop means which typically maintains bias between the mating parts and thus prevents the mating parts from unscrewing and maintains torsional integrity of the joint between the mating parts. When it is required to disengage the mating parts, the stop device can be acted upon from surface, for example by application of a force overcoming the bias, so as to permit the mating parts to rotate relative to each other. The upper string can then be rotated from surface while the stuck portion remains stationary thus permitting the mating parts to disengage.

Disadvantages associated with such known back off subs include, for example, the risk of accidental disengagement of the mating parts of the back off sub during the normal downhole activity and the associated financial losses due to the non-production time required to re-connect the string.

The aim of this invention is to provide a tool with the features mentioned in the first paragraph of this description, which does not present said disadvantages.

This aim is achieved by providing a tool for selectively connecting or disconnecting components of a downhole workstring comprising a drive shaft and a housing couplable to said drive shaft, said housing comprising a first housing part and a second housing part releasably connected to one another, and further comprising transmission means coupled to the drive shaft, said transmission means being arranged to selectively connect or disconnect the housing parts by rotating the drive shaft.

Preferably, said transmission means are arranged so that the rotation of said drive shaft causes a longitudinal displacement of one of the housing parts, or of an operating member for connecting or disconnecting said housing parts, and that the housing parts are connected or disconnected as a result of said axial displacement.

Advantageously, the tool comprises a kinematic pair which is selected such that said axial displacement occurs for a predetermined disconnection time before the housing parts disengage.

In a further advantageous arrangement, the tool comprises a gear reduction mechanism.

DESCRIPTION OF INVENTION

In a first special embodiment of the tool according to this invention, said transmission means comprises a gear mechanism arranged for selectively transmitting the torque of said drive shaft to one of said housing parts, said gear mechanism comprising an output gear element of which a threaded portion is coupled to a threaded portion of an operating member for connecting or disconnecting said housing parts, such that rotational motion of the output gear element results in axial displacement of said operating member.

Preferably, the gear mechanism of said first special embodiment comprises a harmonic drive having a reference gear element, which is fixed to or integrally formed with said housing part, an input gear element fixed to said drive shaft, and an output gear element, such that rotation of the input gear element relative to the reference gear element results in rotation of the output gear element.

In this first special embodiment, the first housing part and the second housing part preferably comprise a set of longitudinally spaced first reception cavities and a set of longitudinally spaced second reception cavities respectively, the connected housing parts are in a relative position wherein the first cavities and the second cavities are aligned in transversal direction, and the tool further comprises

- a number of movable connection elements, each connection element being associated with a respective pair of aligned first and second cavities, and being selectively positionable in a connecting position wherein it extends in both aligned cavities of its associated pair, thereby preventing relative longitudinal displacement of the housing elements, and a disconnecting position wherein it does not extend in both aligned cavities of said pair, and
- an operating member for selectively positioning said connection elements in the connecting position or allowing the connection elements to move or to be moved into the disconnecting position, so that the housing parts are connected or disconnected.

Advantageously, said operating member is longitudinally displaceable between a holding position wherein it is holding each connection member in a respective connecting position, and a releasing position wherein the connection members are allowed to move or to be moved into the disconnecting position.

In a further advantageous embodiment, said operating member comprises a set of longitudinally spaced third reception cavities, such that, when the operating member is placed in the releasing position, each third cavity is aligned with a respective pair of aligned first and second cavities, and the connecting elements are allowed to move or to be moved to a disconnecting position wherein they are removed from the first cavities and extending in the aligned second and third cavities.

In a specific embodiment the first reception cavities are transversal recesses in the first housing part, the second reception cavities are holes in the second housing part, the connection elements are blocks fitting in a respective alignment of a hole and a recess, and the third reception cavities are recesses in the operating member.

In a most preferred embodiment, each pair of aligned first and second reception cavities define a reception space delimited by at least one inclined end surface, such that a connection element, when positioned in its connection position, is transversally moved towards its disconnection position, when a force acting in longitudinal direction pushes said connection element against said inclined surface, said force being the result of gravity and/or the result of a relative longitudinal displacement of the housing parts.

The tool according to said first special embodiment preferably also comprises a coupling member which is selectively displaceable between a coupling position and an uncoupling position wherein the drive shaft and one of the housing parts are coupled and uncoupled respectively.

Further preferably, this coupling member is displaceable in a space which is in communication with a fluid channel of the tool through at least one aperture, the tool further comprises a spring member urging the coupling member towards its coupling position, and an operating assembly for selectively opening or closing said aperture so that, when the aperture is open, a fluid flowing in the fluid channel is allowed to enter the space through said aperture, thereby exerting a force on said coupling member resulting in its displacement into the uncoupling position, and that, when the aperture is closed, the coupling member is moved into the coupling position by said spring member.

Ideally, said operating assembly comprises

- a sleeve located inside said fluid channel, said sleeve being movable between a closing position wherein it closes said aperture and an opening position wherein it leaves said aperture open,
- an object insertable in said fluid channel,
- a trap for capturing and holding the object in the channel,
- a spring element urging the movable sleeve towards its closing position, said operating assembly being arranged so that, when a fluid is flowing in the fluid channel, the insertion of the object and its resulting position in the trap influences the fluid pressure in the channel such that said sleeve is moved into the opening position, and that, when the object is not positioned in the trap, the sleeve is moved into the closing position by said spring element.

As an alternative for said first special embodiment, and in accordance with this invention, the tool can also be constructed as a second special embodiment, having the following features: a tool for selectively connecting or disconnecting components of a downhole workstring, in particular a downhole back off sub, comprising a housing couplable with a drive shaft, the housing comprising a pair of housing parts arranged to rotate relative to each other about a common rotation axis; the housing parts being engaged together via a kinematic pair arranged to translate the relative rotation of the housing parts into longitudinal displacement of the housing parts relative to each other and relative to the common rotation axis, and a transmission mechanism arranged to selectively transmit the rotation of the drive shaft to at least one of the pair of the housing parts thereby inducing the relative rotation of the housing parts and the resulting relative longitudinal displacement of the housing parts.

Some preferred features of the second special embodiment will now be described hereinafter. Though the first and second special embodiment are presented as alternative embodiments of this invention. It will be apparent that some of the features of the second special embodiment mentioned below are readily available for incorporation in the first special embodiment, and vice versa, even when this has not been explicitly mentioned.

The drive shaft is typically that of a workstring, which can be for example a drillstring, fishing string, washover string, logging string etc. The drive shaft typically is or is connected to a drive shaft of a motor which may be a motor at surface, such as e.g. a top drive. In drilling activities, the rotation of the motor at surface is typically transferred downhole by a drill pipe, i.e. the drill pipe serves as a drive shaft. It is envisaged that in other cases, e.g. in coiled tubing drilling or other downhole activities, the drive shaft may be that of a mud motor, that is, a downhole motor driven by a column of mud within a workstring.

In use, the tool of the invention is assembled with the workstring so that the housing is coupled with the drive shaft via the transmission mechanism.

Preferably, one part of the housing remains stationary during the relative rotation and the other part of the housing rotates about the rotation axis.

Preferably, the transmission mechanism comprises a gear box. Preferably, the transmission mechanism is a reducer.

Preferably, the transmission mechanism includes a locking means for selectively locking or unlocking at least one housing part so as to restrict or permit rotation of the housing part with respect to the drive shaft, wherein the tool is arranged to operate in a locked mode, in which the locking means locks the at least one housing part to the drive shaft whereas the transmission mechanism is engaged, with the result that the housing parts are rotatable as a unit with the drive shaft, so that torque and rotation from the drive shaft can be transmitted to the relevant equipment of the workstring.

Thus, in the locked mode, which is required during normal operation of the workstring (e.g. during drilling), torque and rotation from the drive shaft is transmitted to the relevant equipment downstring of the back off sub.

Further preferably, the transmission mechanism includes an interruption means for interrupting or engaging the transmission mechanism to respectively disable or enable the transmission from the drive shaft to the housing part through the transmission mechanism, wherein the tool is arranged to operate in a back off mode, in which the locking means is actuated and the housing part previously locked to the drive shaft becomes released therefrom, i.e. the housing part becomes unlocked for rotation relative to the other housing part, whereas the transmission mechanism remains engaged, so that torque and rotation from the drive shaft can be transmitted through the transmission mechanism to cause the relative rotation of the housing parts.

Preferably, the locking means and the interruption means are arranged in a cooperative relationship so that the back off sub selectively operates in a number of modes and more preferably, in at least a locked mode and a back off mode. Further preferably, the locking means and the interruption means are arranged in a cooperative relationship so that the back off sub selectively operates in a re-connection mode.

If for whatever reason it is required to disconnect the equipment downstring of the back off sub, e.g. if it has been fixed in place or becomes stuck downhole the back off sub is brought into a back off mode.

Preferably, one part of the housing is in use non-rotatably attached to equipment downstring of the back of sub. Accordingly, this part of the housing, which in use is typically a lower part, remains stationary downhole if the equipment has been fixed in place or becomes stuck downhole, whereas the other part of the housing, which in use is typically an upper part, is rotated by the transmission mechanism. The relative rotation of the housing parts becomes converted into the relative axial movement of the housing parts by the kinematic pair.

Thus, rotation of the drive shaft in one direction, for example, clockwise, causes one housing part (i.e. the upper, rotatable part) to move away and eventually disconnect from the other (i.e. the lower, stationary) housing part. Accordingly, in the back off mode, the drive shaft rotates but does not transmit rotation to the stationary housing part. Rotation of the drive shaft in the opposite direction, e.g. anticlockwise, results in the reversal of the relative rotation of the housing parts, so that the housing parts move axially toward each other and reconnect. The rotation is transferred from the drive shaft to the housing parts at the reduction ratio provided by the transmission mechanism. Thus, if the transmission mechanism is a reducer, as in a preferred embodiment of the present invention, the relative rotation of the housing parts is slower than the rotation of the drive shaft, and a certain time interval elapses before the housing parts disconnect.

Such a delay is advantageous, for example, if the back off action starts accidentally, because the delay provides an operator with extra time to assess the situation and take the necessary steps to prevent the undesired disengagement. The delay, for example, makes possible an attempt to be made to retrieve the stuck portion of the workstring by application of an axially directed force to the stuck portion, e.g. pushing or pulling force or a dynamic force using a jarring tool, while the housing parts are still in the process of disconnecting, i.e. while the workstring is still one-piece. The delay in disconnection of the housing parts also means that the part of the workstring above the fixed or stuck portion of the workstring rotates during the disconnection process. The relative rotation of the housing parts is advantageous during an attempt to retrieve the stuck portion of the workstring because during the application of such an axial force, a considerable amount of friction is created between the workstring and the walls of the wellbore. The rotation of the upper part of the workstring during the retrieval attempts not only provides additional force in the immediate proximity to the stuck portion of the workstring which may help to release the stuck portion, but also reduces friction in the axial direction and thus facilitates the axial movements of the upper part of the workstring during the retrieval attempt.

In the re-connection mode, which is required, for example, when it is necessary to re-connect the housing parts, the locking means locks at least one housing part to the drive shaft whereas the transmission mechanism is interrupted with the result that the housing part locked to the drive shaft is rotatable as a unit with the drive shaft, that is, rotation and torque are transmitted directly from the drive shaft to that housing part. In the re-connection mode, the stationary housing part remains stationary downhole whereas the rotatable part of the housing is rotated directly by the drive shaft. The relative rotation of the housing parts becomes converted into the relative axial movement of the housing parts by the kinematic pair.

Thus, when the drive shaft rotates in one direction, for example, clockwise, one housing part (i.e. the upper, rotatable part) to moves towards and eventually re-connects with the stationary (i.e. the lower, stationary) housing part. The rotation of the drive shaft is transferred from the drive shaft to the rotatable housing part directly, i.e. the angular speed of the rotatable housing part is the same as that of the drive shaft. This is advantageous when it is required to re-connect the housing parts at a speed different than that provided by the transmission mechanism. If the transmission mechanism is a reducer, in the re-connection mode, re-connection of the housing parts occurs quicker than in the back off mode, which is desirable in the production environment. In the re-connection mode, the drive shaft thus rotates but does not transmit rotation to the stationary housing part. Rotation of the drive shaft in the opposite direction, e.g. anticlockwise, results in the reversal of the relative rotation of the housing parts, so that the housing parts move axially away from each other and disconnect. This may be required when, for example, the transmission mechanism is a reducer and for whatever reason it is required to disconnect the housing parts faster than the disconnection time provided for by the transmission mechanism.

Advantageously, the kinematic pair is selected such that the relative axial displacement of the housing parts occurs for a predetermined time before the housing parts disengage. Such an arrangement is advantageous in case, as explained above in connection with the transmission mechanism, the locking means unlocks inadvertently because the prolonged axial displacement provides sufficient time for an operator at surface to detect a lowered torque exerted by the drive shaft indicating that the disengagement process has begun and to take measures to prevent further disengagement and to re-connect the housing parts by switching the direction of rotation of the drive shaft to rotate in the opposite direction or by bringing the back off sub into the re-connection mode in which the drive shaft is coupled directly to the rotatable housing part and thus to cause the housing parts to re-engage. Also as explained above in connection with the transmission mechanism, the delay, combined with relative rotation of the housing parts facilitates an attempt to retrieve a stationary portion of the workstring.

In one preferred arrangement, the kinematic pair is provided in the form of a pair of cooperating threads between the housing parts. Preferably, the pitch of the threads is selected so that the longitudinal displacement of the housing parts per revolution of the drive shaft is relatively small and the housing parts move a relatively small total axial distance during the predetermined time interval as the housing parts engage or disengage. This adds to the compactness of the design of the back off sub of the invention while ensuring that the housing parts remain engaged for the predetermined time interval. Such threads facilitate a slow pace of the axial disengagement of the housing parts compared to the angular speed of rotation of the drive shaft.

In one arrangement, the threads are fine-pitch threads. For the back off sub of the present invention, a pitch of 1 mm, 2 mm or 3 mm would be regarded as a fine-pitch. Combined with appropriately selected length in the axial direction of the threaded connection and transmission ratio of the transmission mechanism, the required disconnection time is achieved. For example, for 1 mm pitch and 100 mm long thread connection and a 100:1 reduction ratio of the transmission mechanism, rotation at input at 100 rpm results in 50 min thread disconnection (or connection) time involving 50 thread revolutions and 5000 drive shaft revolutions.

Further preferably, the kinematic pair is selected such that it has tensile strength in the axial direction in a state when the kinematic pair has disconnected by about 75-85% approximately the same or greater than the tensile strength of the part of the workstring which becomes stationary downhole. Such an arrangement helps to ensure that the kinematic pair does not break when an attempt is made to retrieve a stuck portion of the workstring while the housing parts of the back off sub are in the process of disconnecting.

Preferably, the housing is tubular and the drive shaft extends axially through the housing. Preferably, the pair of housing parts comprise a pair of sleeves connected end-to-end, preferably, co-axially. Preferably, the transmission mechanism is disposed within the housing and is coupled to each housing part.

In an advantageous embodiment, the transmission mechanism comprises a harmonic drive comprising a wave generator (an elliptical disc, plug or hub sometimes also referred to as an inner gear, albeit without teeth), a flexible gear and an outer gear (also referred to as a circular gear), wherein one of the wave generator, flexible gear and outer gear serves as a rotary input component and another of the wave generator, flexible gear and outer gear serves as a rotary output component; and wherein the harmonic drive is couplable with the drive shaft so that rotation of the drive shaft results in the relative rotation of the housing parts. In principle, in its broader aspect, the present invention is not limited to the use of a harmonic drive as a transmission mechanism and indeed can comprise such various transmission mechanisms suitable for co-axial transmission as would be envisaged by a skilled person, such as, for example only, planetary gearing. However, there are certain advantages associated with the use of a harmonic drive in a back off sub of the present invention.

A harmonic drive is a special type of drive and typically comprises a wave generator, also known as an inner gear, an intermediate gear, also known as a flexible gear, and an outer gear, commonly referred to as an outer gear. In a harmonic drive, when the outer gear is fixed, the wave generator and the flexible gear rotate in opposite directions; when the flexible gear is fixed, the outer gear and the wave generator rotate in the same direction; and when the wave generator is fixed, the outer gear and the flexible gear rotate in the same direction. Due to its unique principle of construction, a harmonic drive provides very high or very low, depending on what is used as an input, transmission ratios (typical ratios include 100:1, 200:1, 300:1 or vice versa etc.) along with high torque transmission (due to a plurality of teeth meshing at the same time), torque multiplication (or reduction depending on what is used as an input), very compact construction, rotation precision, low vibration and absence of backlash. Since harmonic drives are known, it is not necessary to describe its construction and operation in detail.

Preferably, in one arrangement, the wave generator of the harmonic drive is coupled to the drive shaft and thus serves as the rotary input component and the flexible gear and the outer gear are each coupled to one of the housing parts and one of the flexible gear or the outer gear serves as a the rotary output component. Thus, the harmonic drive operates as a reducer (and torque multiplier).

In one particular variation, the wave generator of the harmonic drive is coupled to the drive shaft, the outer gear is coupled the housing part which remains stationary during relative rotation and the flexible gear serves as the rotary output component and is coupled to the part of the housing which rotates about the rotation axis relative to the stationary part of the housing. In this variation, the drive shaft and the flexible gear rotate in opposite directions. It is of course in principle possible to couple the outer gear of the harmonic drive to the rotating part of the housing and the flexible gear to the stationary part of the housing. In this case, the rotating part of the housing will rotate in the same direction as the drive shaft. The kinematic pair between the housing parts must be adapted accordingly to suit the applicable direction of rotation of the rotating housing part.

The considerable reduction and torque multiplication provided by the harmonic drive result in the relative rotation of the housing parts much slower than the rotation of the drive shaft but with higher torque compared to other gear boxes. Low speed at the output is beneficial because it provides for a time delay in case the disconnection has been induced accidentally which allows an operator at surface to detect the undesired disconnection process and to take measures to reconnect the housing parts. Also, the delay in disconnection provides for a possibility of an attempt to be made to retrieve the stuck portion of the workstring, for example, by jarring or by straightforward pushing or pulling, while the housing parts are still connected, while the relative rotation of the housing parts provides extra force for retrieval and friction reduction as described above. Torque multiplication may be necessary to translate the rotary motion of the housing parts into the relative axial movement since the connection (i.e. the kinematic pair) between the housing parts may be such as to require high torque to induce the relative movement of the housing parts It is further advantageous to include a combination of a harmonic drive as the transmission mechanism and a threaded connection, preferably, a fine-pitched threaded connection, as the kinematic pair between the housing parts to achieve the necessary disconnection time sufficient for an inadvertent disconnection to be detected at surface and prevented while maintaining compactness of the back off sub of the invention. Also, while such an arrangement provides for the desired relatively slow disconnection of the housing parts, the provision of the re-connection mode provides for a quick re-connection of the housing parts when it is necessary to re-connect the housing parts rapidly compared to the disconnection time.

It will be appreciated that the present invention, in its broader aspect, is not limited to the combination of a threaded connection and a harmonic drive. The required disconnection time, in principle, can be achieved by suitably adapting one or each of the transmission mechanism and the kinematic pair.

Also, preferably, the kinematic pair and/or the transmission mechanism are adjustable to provide for the necessary disconnection time interval.

In one variation, the locking means is provided in the form of a first spline coupling arranged between at least one housing part and the drive shaft to selectively lock and unlock the rotary connection between the housing part and the drive shaft. The splines arrangement may take many forms as will be readily envisaged by a person skilled in the art.

In one variation, the interruption means is provided in the form of a second spline coupling arranged in the transmission mechanism.

Accordingly, in the locked mode, the first spline coupling locks at least one housing part to the drive shaft and the second spline coupling holds transmission mechanism in an engaged mode, with the result that the housing parts are rotatable as a unit with the drive shaft, as described above.

In the back off mode, the first spline coupling is actuated, thus disengaging the first spline coupling, and the housing part previously locked to the drive shaft becomes released therefrom, i.e. the housing part becomes unlocked for rotation relative to the other housing part, whereas the transmission mechanism remains engaged. The first spline coupling can be disengaged by, for example, arranging the drive shaft to move axially within the housing, so that, for example, by pulling the drive shaft towards surface (i.e. applying tension to the workstring) or, as the case may be, pushing it downwardly (i.e. compressing the workstring), away from surface, the first spline coupling becomes disengaged. At the same time, the second spline coupling is preferably configured so that it remains engaged when the first coupling set is disengaged. This can be achieved by selecting appropriate axial dimension and relative position of the second spline coupling taking into account the distance travelled by the drive shaft to disconnect the first spline coupling. Accordingly, torque and rotation from the drive shaft are transmitted through the second spline coupling and through the transmission mechanism to cause the relative rotation of the housing parts at the transmission rate provided by the transmission mechanism, as described above.

In the re-connection mode the first spline coupling locks at least one housing part to the drive shaft, whereas the second spline coupling is interrupted, with the result that the housing part locked to the drive shaft remains rotatable as a unit with the drive shaft, as described above. The second spline coupling can be disengaged by, for example, arranging the drive shaft to move axially within the housing, so that e.g. by pushing the drive shaft downwardly (i.e. compressing the back off sub), i.e. away from surface, or as the case may be, pulling the drive shaft towards the surface (i.e. applying tension to the back off sub), the second spline coupling becomes disengaged while the first spline coupling moves together with the drive shaft and thus remains engaged when the second coupling set is disengaged. This is achieved by selecting appropriate axial dimensions and relative positions of the first spline coupling taking into account the distance travelled by the drive shaft to disconnect the second spline coupling. Accordingly, the stationary housing part remains stationary downhole whereas the rotatable part of the housing is rotated directly by the drive shaft to permit rapid re-connection or disconnection of the housing parts as described above.

Where the transmission mechanism comprises a harmonic drive, the second spline coupling can be provided between the drive shaft and the wave generator. Alternatively, instead of providing a separate second spline coupling, the interruption means can be provided by arranging the wave generator and the flexible gear to be movable axially relative to each other so as to engage or disengage. The wave generator and the flexible gear function in the same manner as described above in connection with the second spline coupling in the locked mode, the back off mode and the re-connection modes.

In the interruption means provided by the wave generator and the flexible gear, the flexible gear preferably includes a flared mouth opening section for receiving and guiding the wave generator into engagement with the flexible gear.

Since the flexible gear and the wave generator are always in register and can be engaged readily irrespective of their relative angular positions (simply by moving the flexible gear and wave generator together so that the wave generator is received within the flexible gear), the use of the wave generator and the flexible gear as the interruption means eliminates the requirement for timing the harmonic drive in order to re-connect interrupted transmission as is the case with a splined type of coupling and, indeed, the need to provide a separate second coupling, whether or not a splined coupling, in the first instance.

Preferably, the flared mouth opening section is configured so that the wave generator is disengaged from the flexible gear when positioned within the flared mouth opening section.

Ideally, the locking means comprises an actuation mechanism adapted to switch the locking means between locked and unlocked modes. Preferably, the actuation mechanism includes a trip mechanism, preferably a hydro-mechanical trip mechanism, actuatable upon a condition indicating that equipment below the back off sub has become stationary and to cause the locking mechanism to unlock.

To detect such condition, a sensor, which may, advantageously, be a mechanical sensor because such a sensor does not require power to operate, is preferably provided sensitive for example to the change in the fluid pressure inside the work string or to the change in the torque, or a specific flow pulse. The trip mechanism can be actuated by application of a force, for example, tensile or compressive force, or upon receipt of a signal which can be provided in the form of a pressure differential, flow pulse, electric, magnetic or electromagnetic field pulse, rate or differential, a specific flow rate or differential. In one specific arrangement, the trip mechanism is configured to induce the axial movement of the drive shaft in relation to the housing upon detection of the condition indicating that the equipment below the back off sub has become stationary. Preferably, the trip mechanism is adjustable to be actuated upon a specific condition.

Ideally, the trip mechanism comprises a delay mechanism configured to prevent the locking means from unlocking for a predetermined time delay interval from the detection of a condition indicating that equipment below the back off sub has become stationary. This prevents the housing parts from beginning to disconnect immediately after the equipment is fixed or stuck. This is advantageous when the equipment below the back off sub is stuck and an attempt to retrieve the stuck objects is necessary or desired, typically by pulling or pushing the workstring from surface with force or by applying a dynamic force, for example, through the use of a jarring tool. If after the predetermined time delay interval the attempt to retrieve the stuck objects is not successful, the trip mechanism causes the locking means to unlock. Preferably, the delay mechanism is adjustable to provide a required time delay interval.

A plurality of such downhole back off subs can be incorporated into a workstring to provide for multiple back off locations along the workstring.

The first and second special embodiment of the invention preferably are made such that the first housing part is connected to an upper workstring, and that the second housing part is connected to a lower workstring or a bottom hole assembly. Preferably, it comprises means for detecting that the second housing part has become stationary.

A further object of this invention is a downhole workstring comprising a tool for selectively connecting or disconnecting components of said workstring, according to this invention.

A still further object of this invention is a method for disconnecting an upper workstring from a stuck lower workstring or a stuck bottom hole assembly of a workstring, wherein a tool according to this invention is used.

In particular, the present invention provides a method of using such a tool, in particular a back off sub, according to the first aspect of the invention, for releasing a part of a workstring which has been deposited downhole or disconnecting parts of workstring downhole, the method comprising providing a back off sub according to the first aspect of the invention;

detecting when a part of the workstring below the back off sub has become stationary downhole;

allowing a predetermined time delay interval to elapse since the workstring below the back off sub has become stationary downhole and before the housing parts of the back off sub begin to disengage; and applying force from surface to the workstring within the predetermined time delay interval in an attempt to release the part of the workstring which has become stationary.

Preferably, the method further comprises actuating the back off sub to disengage the housing parts of the safety sub upon expiry of the predetermined time delay interval.

Preferably, the method further comprises allowing the housing parts to disengage within a predetermined disconnection time.

Preferably, the method further comprises applying force from surface to the workstring while the housing parts are disengaging in an attempt to release the part of the workstring which has become stationary.

Preferably, the method comprises the step of:

within the predetermined disconnection time re-connecting the housing parts.

Preferably, the method comprises the step of:

rotating the drive shaft in the opposite direction to cause reconnection of the housing parts via the transmission mechanism at the transmission ratio determined by the transmission mechanism.

Preferably, the method comprises the steps of:

interrupting the transmission mechanism of the back of sub; and rotating the drive shaft to cause reconnection of the housing parts by directly transferring rotation from the drive shaft to the kinematic pair of the back off sub at the same rotational speed as that of the drive shaft.

In yet another aspect, the present invention provides a method of using a back off sub according to the first aspect of the invention for releasing a part of a workstring which has been deposited downhole or disconnecting or reconnecting parts of workstring downhole, the method comprising providing a back off sub according to the first aspect of the invention; detecting when a part of the workstring below the back off sub has become stationary downhole;

actuating the back off sub to initiate disengagement of the housing parts of the safety sub; allowing the housing parts to disengage within a predetermined disconnection time.

Preferably, the method comprises the step of:

within the predetermined disconnection time, applying axial force to the workstring from surface while the housing parts of the back off sub are being disengaged in an attempt to release the part of the workstring which has become stationary.

Preferably, the method comprises the step of:

within the predetermined disconnection time re-connecting the housing parts.

Preferably, the method comprises the step of:

rotating the drive shaft in the opposite direction to cause reconnection of the housing parts via the transmission mechanism at the transmission ratio determined by the transmission mechanism.

Preferably, the method comprises the step of:

interrupting the transmission mechanism of the back of sub; and rotating the drive shaft to cause reconnection of the housing parts by directly transferring rotation from the drive shaft to the kinematic pair of the back off sub at the same rotational speed as that of the drive shaft.

In still a further aspect, the present invention provides a method of using a back off sub according to the first aspect of the invention for disconnecting or reconnecting parts of workstring downhole, the method comprising providing a back off sub according to the first aspect of the invention;

detecting when a part of the workstring below the back off sub has become stationary downhole;

interrupting the transmission mechanism of the back off sub; and rotating the drive shaft to cause disconnection of the housing parts by directly transferring rotation from the drive shaft to the kinematic pair of the back off sub at the same rotational speed as that of the drive shaft.

Preferably, the method comprises the step of:

rotating the drive shaft in the opposite direction to cause reconnection of the housing parts by directly transferring rotation from the drive shaft to the kinematic pair of the back off sub at the same rotational speed as that of the drive shaft.

The present invention provides a back off sub which is practically fail safe, i.e. it cannot disengage accidentally. The invention also provides a back off sub which enables an attempt to be made to release a part of the workstring which has been lodged downhole before the back off starts disconnecting by providing a delay between the moment when the workstring part becomes lodged and the initiation of the disconnection process. The invention also provides a back off sub which facilitates attempts to release a part of workstring which has become stationary downhole, by reducing friction and providing extra force for the release attempt. The back off sub of the invention provides sufficient time for an attempt to release the stationary part of workstring in case a part of workstring below the back off sub becomes stuck downhole or to reconnect the back off sub in case the disconnection process has initiated by accident before the disconnection is accomplished. The provision of the cooperating threads, preferably, small pitched threads as a kinematic pair and a harmonic drive as the transmission mechanism provides for a compact configuration which is important downhole. The provision of the harmonic drive further provides for low speed and high torque transmission while at the same time allowing the back off sub to remain compact.

DESCRIPTION OF DRAWINGS

The present invention will now be described by way of examples only, with reference to the accompanying drawings in which:

FIGS. 8*a*, 8*b*, 8*c* and 8*d* shows on the left side L the tool in the disconnection mode and on the right side R, the tool in the connection mode.

With reference to FIGS. 1 and 2, a first embodiment of a downhole back off sub of the present invention will be described and is indicated generally by reference numeral 1. The back off sub 1 comprises a housing 2 which in use is mounted on a drive shaft 3 of a workstring. The workstring can be for example a drillstring, a fishing string, a washover string, a logging string etc. The drive shaft 3 typically is or is connected to a drive shaft of a motor which may be a motor at surface, such as e.g. a top drive. In the presently described embodiment, the rotation of the motor at surface is transferred downhole by a drill pipe 4, i.e. the drill pipe 4 serves as a drive shaft. It will be appreciated that in other cases, e.g. in coiled tubing drilling or other downhole activities, the drive shaft 3 may be that of a mud motor, that is, a downhole motor driven by a column of mud within a workstring.

Figure 2:
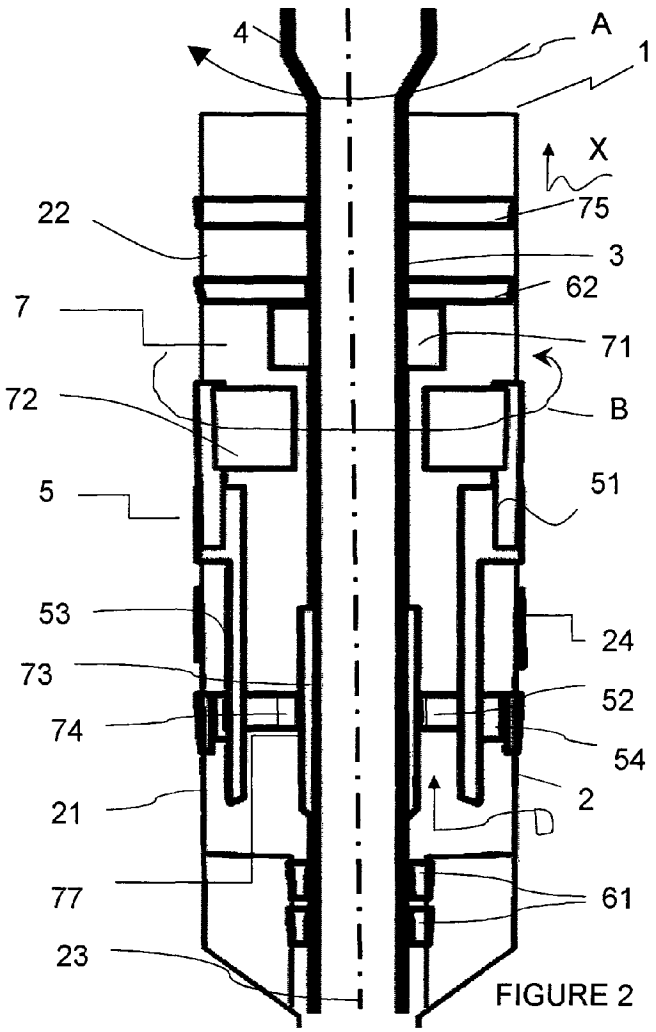
FIG. 2 is a schematic cross-sectional elevation of the back off sub of FIG. 1 in a back off mode in which housing parts of the back off sub rotate relative to each other in order to disengage.

The housing 2 comprises a pair of tubular housing parts, a lower part 21 and an upper part 22. The tubular housing parts 21, 22 are provided in the form of co-axial sleeves, connected end-to-end with each other and arranged to rotate relative to each other about a common rotation axis 23. The drive shaft 3 extends axially through the housing 2. The housing parts 21, 22 are engaged together via a kinematic pair, in this embodiment, co-operating threads 24, provided on each housing part 21, 22 and arranged to translate the relative rotation of the housing parts 21, 22 into longitudinal displacement of the tubular parts 21, 22 relative to each other and relative to the common rotation axis 23. A transmission mechanism 5, provided by in the form of a harmonic drive 51 in the presently described embodiments, as will be described in more detail below, is arranged within the housing 2 to selectively transmit the rotation of the drive shaft 3 to at least one of the pair of the housing parts 21, 22, as will be described in more detail below, in order to induce the relative rotation of the housing parts 21, 22 and the resulting relative longitudinal displacement of the housing parts 21, 22. The housing 2 is mounted on the drive shaft 3 via the transmission mechanism 5, which in the presently described embodiment is coupled to each housing part 21, 22 as will be described below. Seals 61, 62 isolate the interior of the housing 2 from the rest of the workstring.

The transmission mechanism 5 includes a locking mechanism 7, as will be described below, is provided for selectively locking or unlocking the housing part 22 so as to restrict or permit the rotation of the housing part, 22 with respect to the drive shaft 3. The transmission mechanism 5 includes an interruption mechanism 77 for interrupting or engaging the transmission mechanism 5 to respectively disable or enable the transmission from the drive shaft 3 to the housing part 22 through the transmission mechanism 5. Preferably, the locking mechanism 7 and the interruption mechanism 77 are adapted to cooperate so that the back off sub 1 selectively operates in a number of modes, more specifically, in at least a locked mode, a back off mode and, preferably, a re-connection mode.

Figure 1:
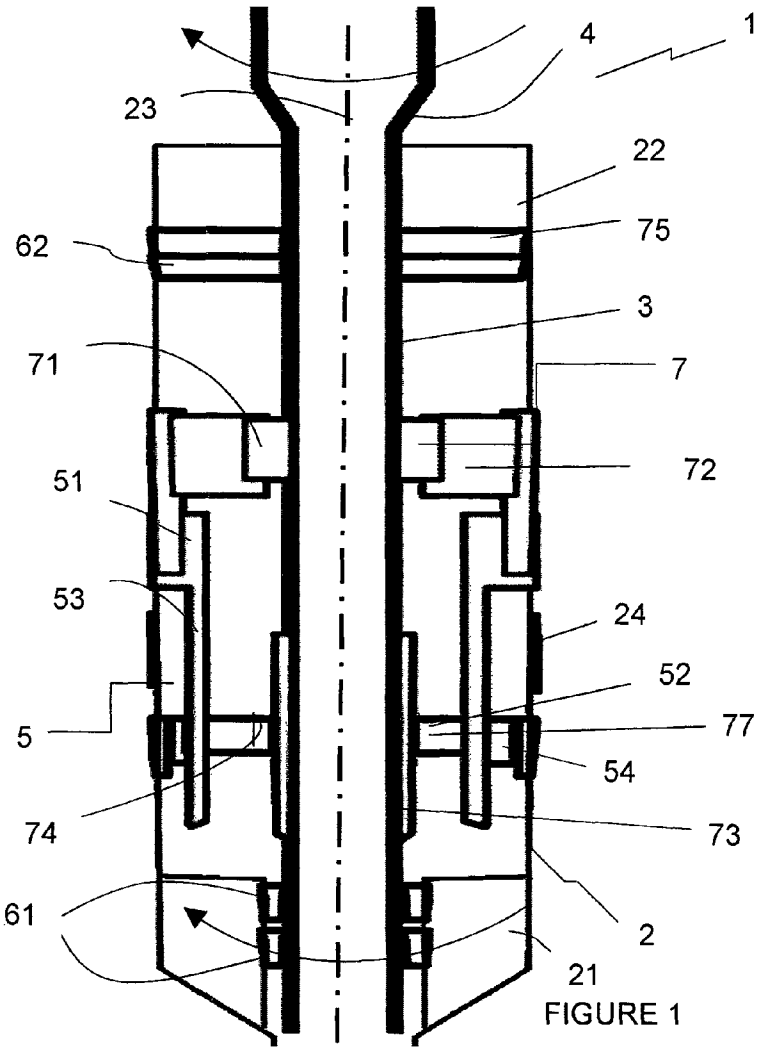
FIG. 1 is a schematic cross-sectional elevation of a first embodiment of the back off sub of the invention in a locked mode in which the back off sub is rotatable with a workstring as a unit.

In a locked mode, the locking mechanism 7 locks the housing part 22 to the drive shaft 3 while the transmission mechanism 5 is engaged, with the result that the housing parts 21, 22 cannot rotate relative to each other and, instead, rotate as a unit together with the drive shaft 3 as indicated by arrows in FIG. 1. The locked mode is maintained during normal operation of the workstring so that torque and rotation from the drive shaft 3 are transmitted through the back off sub 1 to the relevant equipment below the back off sub 1.

If and when it is required to disconnect the equipment below the back off sub 1, typically, if it is stuck downhole or has been installed or fixed in place the back off sub is brought into a back off mode. In the back off mode, the locking mechanism is actuated and the housing part 22 becomes released from the drive shaft 3, whereas the transmission mechanism 5 remains engaged. In the back off mode, the torque and rotation (indicated by arrow A in FIG. 2) is transmitted from the drive shaft 3 through the transmission mechanism 5 to cause the relative rotation of the housing parts 21, 22. The part 21 of the housing 2, i.e. a lower part which is positioned adjacent the equipment downstring of the back off sub 1, is non-rotatably connected to the equipment. Thus, when the equipment is stuck or fixed, the lower part 21 of the housing 2 becomes stationary. When the housing parts 21, 22 are unlocked in order to disconnect, the lower part 21 remains still, whereas the housing part 22, i.e. an upper part, is rotated about the rotation axis 23 by the transmission mechanism 5. The rotation of the upper part 22 (indicated by arrow B in FIG. 2) becomes converted into the relative axial movement of the housing parts 21, 22 by the cooperating threads 24. During the relative axial movement of the housing parts 21, 22, the upper part 22 is moved away from the lower part 21 as indicated by arrow X in FIG. 2, thereby causing the upper part 22 to disconnect from the lower fixed or stuck part 21. Meanwhile, the drive shaft 3 rotates within the housing 2 but does not transmit rotation to the lower part 22.

Rotation of the drive shaft 3 in the opposite direction, e.g. anticlockwise, results in the reversal of the rotation of the housing part 22, so that the housing parts 21, 22 move axially toward each other and reconnect.

The rotation is transferred from the drive shaft 3 to the housing part 22 at the reduction ratio provided by the transmission mechanism 5. If the transmission mechanism is a reducer, as the harmonic drive 51 of the presently described embodiment, the relative rotation of the housing parts 21, 22 is slower than the rotation of the drive shaft 3, and, accordingly a certain time interval elapses before the housing parts 21, 22 disconnect. This delay is advantageous, for example, if the back off action starts accidentally, because the delay provides an operator with extra time to assess the situation and take the necessary steps to prevent the undesired disengagement. The delay in disconnection of the housing parts 21, 22 also means that the part of the workstring above the fixed or stuck portion of the workstring rotates during the disconnection process. The relative rotation of the housing parts 21, 22 is advantageous during an attempt to retrieve the stuck portion of the workstring because during the application of such an axial force, a considerable amount of friction is created between the workstring and the walls of the wellbore. The relative rotation of the housing parts 21, 22 during the retrieval attempts not only provides additional force in the immediate proximity to the stuck portion of the workstring which may help to release the stuck portion, but also reduces friction in the axial direction and thus facilitates the axial movements of the upper part of the workstring during the retrieval attempt.

Although not shown in FIGS. 1 and 2, the back off sub 1 can be readily modified to operate in a re-connection mode (which is required, for example, when it is necessary to re-connect the housing parts 21, 22, the locking mechanism 7 locks the housing part 22 to the drive shaft 3 whereas the transmission mechanism 5 is interrupted with the result that the housing part 22 locked to the drive shaft 3 is rotatable as a unit with the drive shaft 3, that is, rotation and torque are transmitted directly from the drive shaft 3 to the housing part 22. In the re-connection mode, the stationary housing part 21 remains stationary downhole whereas the rotatable part 22 of the housing is rotated directly by the drive shaft 3. The relative rotation of the housing parts 21, 22 becomes converted into the relative axial movement of the housing parts 21, 22 by the cooperating threads 24. Thus, when the drive shaft 3 rotates in one direction, for example, clockwise, the housing part 22 moves towards and eventually re-connects with the stationary housing part 21. The rotation of the drive shaft 3 is transferred from the drive shaft 3 to the rotatable housing part 22 directly, i.e. the angular speed of the rotatable housing part 22 is the same as that of the drive shaft 3. This is advantageous when it is required to re-connect the housing parts 21, 22 at a speed different than that provided by the transmission mechanism 5. If the transmission mechanism 5 is a reducer, as in the presently described embodiment, in the re-connection mode, re-connection of the housing parts 21, 22 occurs quicker than in the back off mode, which is desirable in the production environment. In the re-connection mode, the drive shaft 3 thus rotates but does not transmit rotation to the stationary housing part 21. Rotation of the drive shaft 3 in the opposite direction, e.g. anticlockwise, results in the reversal of the relative rotation of the housing parts 21, 22, so that the housing parts 21, 22 move axially away from each other and disconnect. This may be required when, for example, the transmission mechanism 5 is a reducer, as in the presently described embodiments, and it is required to disconnect the housing parts 21, 22 faster than the disconnection time provided for by the transmission mechanism 5.

The cooperating threads 24 are selected such that the relative axial displacement of the housing parts 21, 22 occurs for a predetermined time before the housing parts 21, 22 disengage. Such an arrangement, as discussed above, is advantageous in case the locking mechanism 7 unlocks inadvertently or accidentally, because the prolonged disengagement process provides sufficient time for an operator at surface to detect a lowered torque exerted by the drive shaft 3 indicating that the disengagement process between the housing parts 21, 22 has begun, and to take measures to prevent further disengagement, i.e. to re-connect the housing parts 21, 22 by switching the direction of rotation of the drive shaft 3 to rotate in the opposite direction or by bringing the back off sub 1 into the re-connection mode in which the drive shaft 3 is coupled directly to the rotatable housing part 22 with the transmission mechanism 5 being interrupted, and thus causing the housing parts 21, 22 to re-engage. Also as explained above in connection with the transmission mechanism, such a prolonged disconnection time of the housing parts 21, 22, combined with the relative rotation of the housing parts 21, 22 facilitates an attempt to retrieve a stationary portion of the workstring, e.g. by jarring or by simple pushing or pulling.

In the presently described embodiment, the pitch of the cooperating threads 24 is selected so that the longitudinal displacement of the housing parts 21, 22 per revolution of the drive shaft 3 is relatively small and the housing parts move a relatively small total axial distance during the predetermined time interval as the housing parts engage or disengage. This adds to the compactness of the design of the back off sub of the invention while ensuring that the housing parts 21, 22 remain engaged for the predetermined time interval. The threads 24 can be fine-pitch threads. The threads 24 provide for a slow pace of the axial disengagement of the housing parts 21, 22 compared to the angular speed of rotation of the drive shaft 3. For the back off sub of the present invention, a pitch of 1 mm, 2 mm or 3 mm would be regarded as a fine-pitch. Combined with appropriately selected length in the axial direction of the threaded connection and transmission ratio of the transmission mechanism 5, the required disconnection time is achieved. For example, for 1 mm pitch and 100 mm long thread connection and a 100:1 reduction ratio of the transmission mechanism, rotation at input at 100 rpm results in 50 min thread disconnection (or connection) time involving 50 thread revolutions and 5000 drive shaft 3 revolutions.

Furthermore, the threads 24 are selected such that the threaded connection has a tensile strength in the axial direction in a state when the threads have disconnected by about 75-85% approximately the same or greater than the tensile strength of the part of the workstring which becomes stationary downhole. This prevents the threaded connection from breaking when an attempt is made to retrieve a stuck portion of the workstring while the housing parts 21, 22 of the back off sub are in the process of disconnecting.

In the presently described embodiment, the transmission mechanism 5 comprises a harmonic drive 51 comprising a wave generator 52, a flexible gear 53 and a circular (outer) gear 54. The wave generator 52 is mounted on the drive shaft 3 and serves as a rotary input component of the harmonic drive 51. The flexible gear 53 is coupled with the upper housing part 22 and serves as a rotary output component of the harmonic drive 51. The outer gear 54 is coupled with the lower housing part 21. When the harmonic drive 51 is in operation, i.e. when the housing parts 21, 22 are unlocked for relative rotation, the outer gear 54 remains stationary together with the lower housing part 21, which, in turn, is non-rotatably coupled to the equipment below the back off sub 1, while the flexible gear 53 rotates the upper housing part 22. Inherent to the principle of construction of harmonic drive, the wave generator 52 and the flexible gear 53 rotate in opposite directions as indicated by arrows A and B respectively in FIG. 2. It is of course in principle possible to couple the outer gear 54 of the harmonic drive 51 to the upper housing part 22 and the flexible gear 53 to the lower part 21 of the housing. In this case, the upper part 22 of the housing 2 will rotate in the same direction as the drive shaft 3. The threaded connection between the housing parts 21, 22 must be adapted accordingly to suit the applicable direction of rotation of the rotating housing part 21.

Due to the principle of its construction, the harmonic drive 51 provides considerable reduction, which can be for example, 100:1, 200:1, 300:1, which means that the upper housing part 22 rotates very slowly compared to the drive shaft 3 the rotational speed of which is typically 30-150 rpm. The reduction combined with the small pitch threaded connection result in that disconnection of the housing parts 21, 22 does not occur instantly or soon after the disconnection process has begun. Instead, a certain time period elapses before the housing parts 21, 22 are disconnected and this time is sufficient for an operator at surface to become aware that the disconnection process has started and to react by taking measures to stop the disconnection and to re-connect the housing parts 21, 22 in case the disconnection process started accidentally. Also, the delay in disconnection provides for a possibility of an attempt to be made to retrieve the stuck portion of the workstring, for example, by jarring or by straightforward pushing or pulling, while the housing parts 21, 22 are still connected, while the relative rotation of the housing parts 21, 22 provides extra force for retrieval and friction reduction as described above.

Due to the principle of its construction, along with considerable reduction, the harmonic drive 51 provides torque multiplication (which is inversely proportional to the reduction). The plurality of teeth meshing at the same time in the harmonic drive 51 facilitates high torque transmission. High torque is required to rotate the housing parts 21, 22 relative each other via the cooperating threads 24 to translate the rotary motion of the housing parts 21, 22 into the relative axial movement of the housing parts 21, 22. The plurality of meshing teeth also provide for low vibration and absence of backlash, unlike other gear boxes.

Due to the co-axial arrangement of the rotating components of the harmonic drive 51, very compact configuration is achieved which is crucial in downhole tools.

In the embodiment of FIGS. 1 and 2, the locking mechanism 7 is provided in the form of a first set of cooperating splines (first spline coupling) 71, 72 arranged between the housing 2 and the drive shaft 3 to selectively lock and unlock the rotary connection between the housing parts 21, 22. A first spline 71 is provided on the drive shaft 3 and a second spline 72 is provided on the upper part 22 of the housing 2. In the present embodiment, the second spline 72 is provided on the flexible gear 53. The splines 71, 72 are releasably engageable. This is achieved by arranging the drive shaft 3 to be movable axially with respect to the housing 2. When the splines 71, 72 are engaged, the upper part 22 of the housing 2 is locked to the drive shaft 3 and the entire housing 2 thus rotates as a unit with the drive shaft 3 during the normal operation of the downhole equipment. This is a locked mode of the back off sub 1.

When it is required to disengage the housing parts 21, 22 via the harmonic drive 51 the back off sub 1 is switched to a back off mode in which the drive shaft 3 is caused to slide axially in relation to the housing 2 (in the present embodiment, upwardly as indicated by arrow D in FIG. 2), thereby withdrawing the first spline 71 from engagement with the second spline 72 and unlocking the rotatable upper part 22 of the housing 2 to permit the relative rotation of the housing parts 21, 22. The interruption mechanism 77 is provided in the form of another set of cooperating splines 73, 74 (second spline coupling) provided between the drive shaft 3 and the wave generator 52. The cooperating splines 73, 74 remain engaged when the drive shaft 3 is moved axially in relation to the housing 2 to disengage the splines 71, 72 of the first set. This is achieved by selecting appropriate axial dimensions and relative positions of the splines 73, 74 taking into account the distance travelled by the drive shaft 3 to disconnect the first splines 71, 72. With the splines 73, 74 engaged and the splines 71, 72 disengaged, torque and rotation from the drive shaft 3 is transmitted through harmonic drive 51 (i.e. the harmonic drive works as a reducer and torque multiplier) to cause the relative rotation of the housing parts 21, 22 at the transmission rate provided by the harmonic drive 51.

To be capable of operating in the re-connection mode, the back off sub 1 of FIGS. 1 and 2 cab be readily modified, e.g. by appropriately adjusting the dimensions and relative axial positioning of the splines 71, 72, 73 and 74 so that the splines 71, 72 remain engaged while the splines 73 and 74 come out of engagement to interrupt the transmission between the drive shaft 3 and the rotatable housing part 22, with the result that the housing part 22 locked to the drive shaft 3 remains rotatable as a unit with the drive shaft. This is achieved by selecting appropriate axial dimensions and relative positions of the first splines 71, 72 taking into account the distance travelled by the drive shaft 3 to disconnect the second splines 73, 74. In the presently described example, the splines 73, 74 are disengaged by pushing the drive shaft 3 downwardly (i.e. compressing the workstring) while the splines 71, 72 move together with the drive shaft 3 and thus remain engaged when the splines 73, 74 become disengaged. Accordingly, the stationary housing part 21 remains stationary downhole whereas the rotatable part 22 of the housing 2 is rotated directly by the drive shaft 3 to permit re-connection or disconnection of the housing parts 21, 22 at a the transmission ratio 1:1, as described above.

The locking mechanism 7 comprises an actuation mechanism 75 for actuating the locking mechanism 7 between locked and unlocked modes. In the presently described embodiment, the actuation mechanism 75 is provided in the form of a trip mechanism, such as a hydro-mechanical trip mechanism, actuatable upon a condition indicating that equipment below the back off sub has become stationary and to cause the locking mechanism 7 to unlock. To detect such condition, a sensor (not shown) can be provided sensitive for example to the change in the fluid pressure inside the drill string or to the change in the torque. The trip mechanism can be actuated by application of a force, for example, tensile or compressive force, or upon receipt of a signal which can be provided in the form of a pressure differential, flow pulse, electric, magnetic or electromagnetic field pulse, rate or differential, a specific flow rate or differential. Upon detection of the condition indicating that equipment below the back off sub 1 has become stationary the trip mechanism 75 induces the axial movement of the drive shaft 3 in relation to the housing 2 as indicated by the arrow D in FIG. 2.

Furthermore, the trip mechanism 75 comprises a delay mechanism (not shown) configured to prevent the locking mechanism 7 from unlocking for a predetermined time delay interval (e.g. 30 min or 1 hour) from the detection of the condition indicating that equipment below the back off sub 1 has become stationary. This prevents the housing parts 21, 22 from disconnecting immediately after the workstring has become fixed or stuck. This is advantageous when equipment below the back off sub 1 becomes stuck and an attempt to retrieve the stuck objects is necessary or desired by pulling or pushing the workstring from surface with force, or by applying a dynamic force using a jarring tool. If after the predetermined time delay interval the attempt to retrieve the stuck objects is not successful, the trip mechanism 75 causes the locking mechanism 7 to unlock. In the present embodiment, the drive shaft 3 is caused to slide axially upwardly thereby causing the splines 71, 72 to disconnect thereby permitting the housing parts 21, 22 to rotate relative to each other. The delay mechanism is preferably adjustable to provide a required time delay interval.

Figure 4:
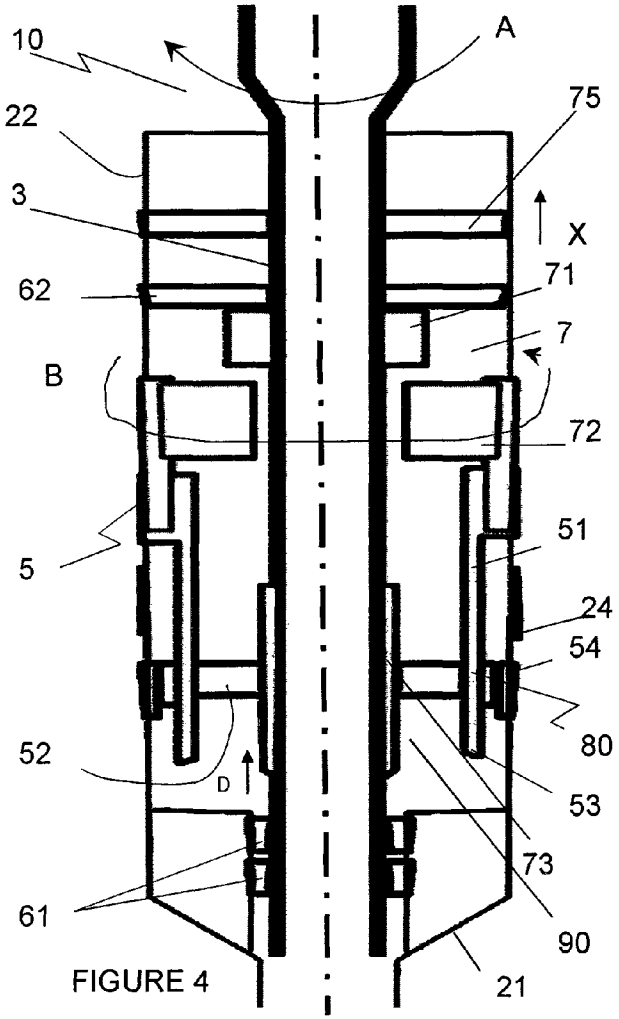
FIG. 4 is a schematic cross-sectional elevation of the back off sub of FIG. 3 in a back off mode in which housing parts of the back off sub rotate relative to each other in order to disengage.
Figure 3:
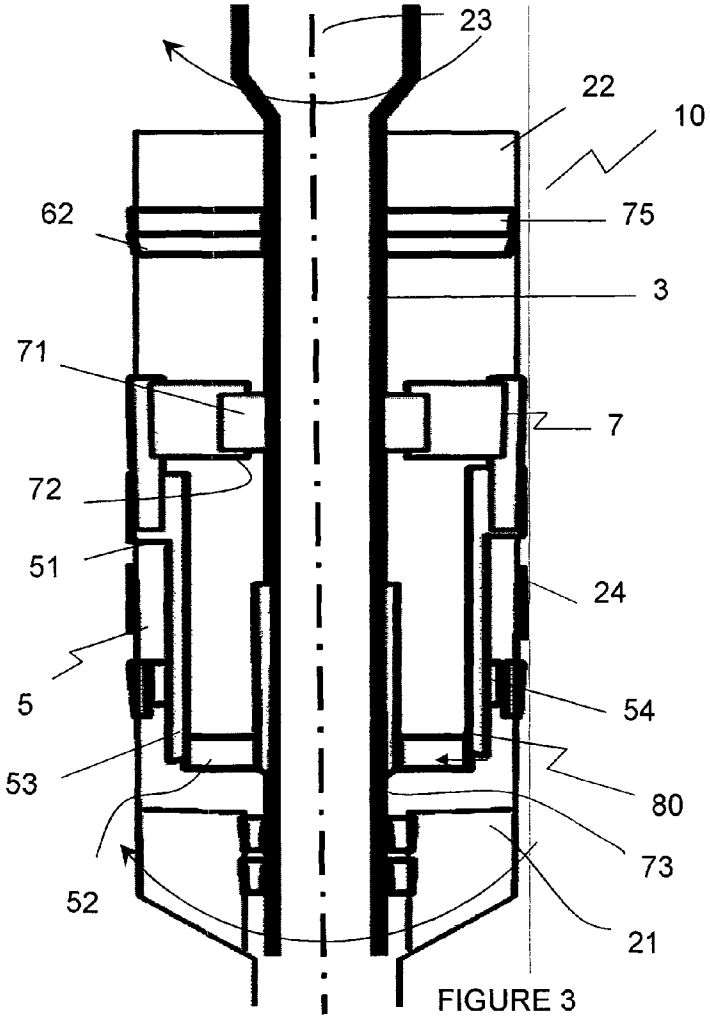
FIG. 3 is a schematic cross-sectional elevation of a second embodiment which is a modification of the first embodiment of the back off sub of the invention in a locked mode in which the back off sub is rotatable with a workstring as a unit.

In FIGS. 3 and 4, a modification of the back off sub 1 is schematically illustrated and is indicated generally by reference numeral 10. The back off sub 10 of FIGS. 3 and 4 is the same as the back off sub of FIGS. 1 and 2 in most aspects but for the arrangement of interruption mechanism indicated generally 80 in FIGS. 3 and 4. Therefore, components of the back off sub 10 are indicated in FIGS. 3 and 4 using the same reference numerals as those used to indicate corresponding components of the back off sub 1 of FIGS. 1 and 2. In the interruption mechanism 80 of the back off sub 10, the spline 73 is configured as a unit with the wave generator 52 and the interruption mechanism 80 is provided by arranging the wave generator 52 and the flexible gear 53 to be movable axially relative to each other so as to engage or disengage. The wave generator 52 and the flexible gear 53 function in the same manner as described above in connection with the back off sub 1 of FIGS. 1 and 2 in the locked mode, the back off mode and the re-connection modes. The flexible gear 53 includes a flared mouth opening section 90 for receiving and guiding the wave generator 52 into engagement with the flexible gear 53. Since the flexible gear 53 and the wave generator 52 are always in register and can be engaged readily irrespective of their relative angular positions (simply by moving the flexible gear 53 and wave generator 52 together so that the wave generator is received within the flexible gear), the use of the wave generator 52 and the flexible gear 53 as the interruption mechanism 80 eliminates the requirement for timing the harmonic drive 51 in order to re-connect interrupted transmission as is the case with a splined type of coupling of FIGS. 1 and 2 and, indeed, the need to provide a separate second coupling, whether or not a splined coupling, in the first instance. The flared mouth opening section 90 is configured so that the wave generator 52 is disengaged from the flexible gear 53 when positioned within the flared mouth opening section 90.

Figure 7:
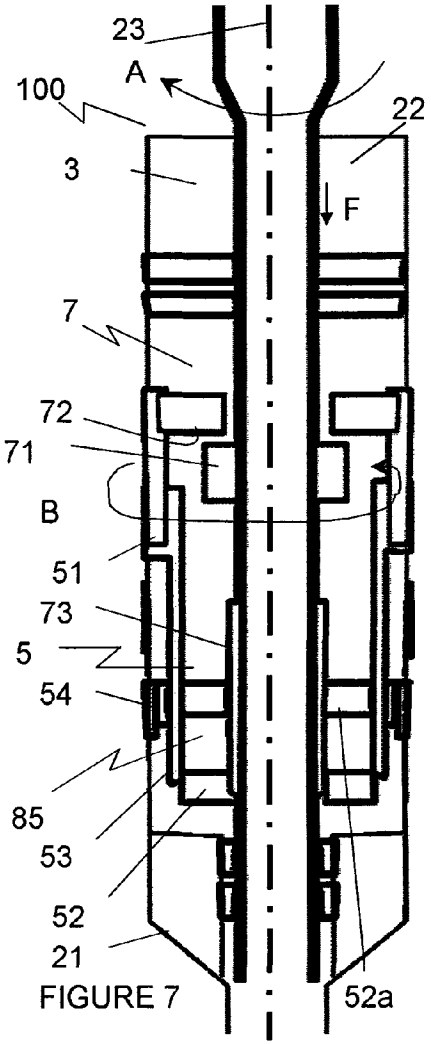
FIG. 7 is a schematic cross-sectional elevation of the back off sub of FIG. 5 in a back off mode in which housing parts of the back off sub rotate relative to each other in order to disengage and in which compression is applied to the housing in order to bring it into the back off mode.
Figure 6:
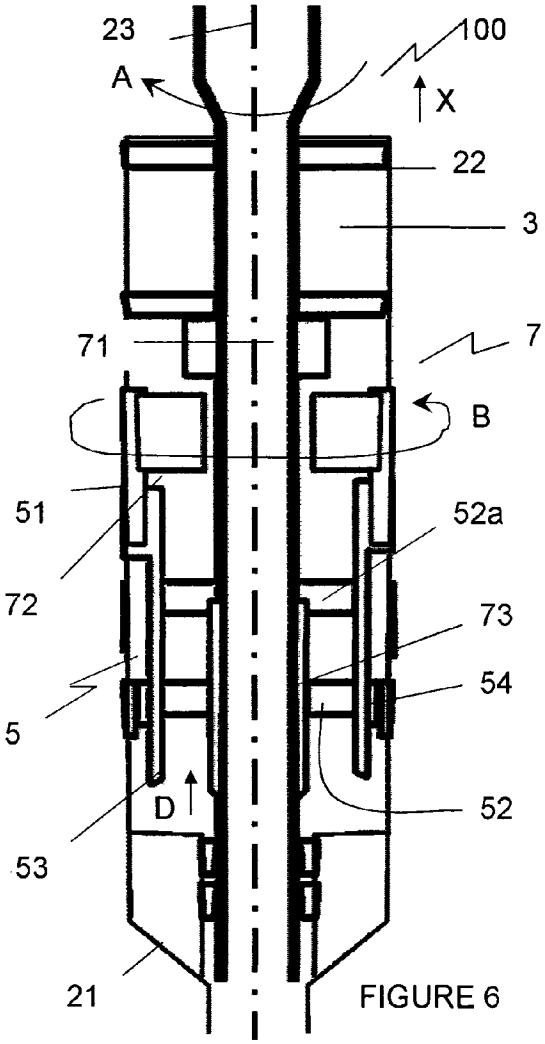
FIG. 6 is a schematic cross-sectional elevation of the back off sub of FIG. 5 in a back off mode in which housing parts of the back off sub rotate relative to each other in order to disengage and in which tension is applied to the housing in order to bring it into the back off mode.
Figure 5:
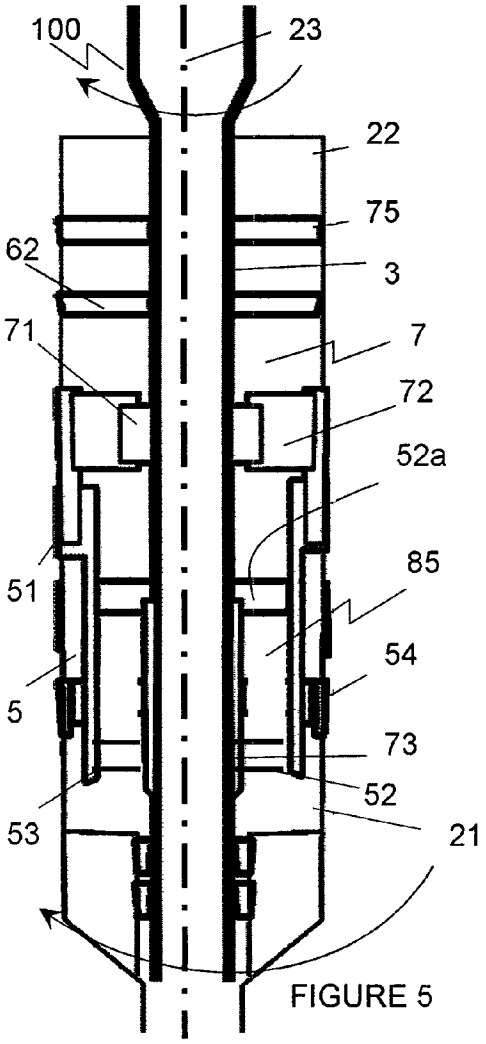
FIG. 5 is a schematic cross-sectional elevation of a third embodiment which is a modification of the second embodiment of the back off sub of the invention in a locked mode in which the back off sub is rotatable with a workstring as a unit.

In FIGS. 5, 6 and 7, a modification of the back off sub 10 is schematically illustrated and is indicated generally by reference numeral 100. The back off sub 100 of FIGS. 5, 6 and 7 is similar to the back off sub of FIGS. 3 and 4 but for the arrangement of the interruption mechanism indicated generally 85 in FIGS. 5, 6 and 7. Therefore, components of the back off sub 100 are indicated in FIGS. 5, 6 and 7 using the same reference numerals as those used to indicate corresponding components of the back off sub 10 of FIGS. 3 and 4. In the interruption mechanism 85 of the back off sub 100, the spline 73 is configured as a unit with the wave generator 52 and the interruption mechanism 80 is provided by arranging the wave generator 52 and the flexible gear 53 to be movable axially relative to each other so as to engage or disengage, as in the back off sub 10 of FIGS. 3 and 4. Additionally, a second wave generator 52*a* is provided axially spaced from the first wave generator 52. Such an arrangement allows the back off mode to be achieved in two ways. The first way is illustrated in FIG. 6 and is the same as described above in connection with FIGS. 2 and 4, i.e. by pulling the drive shaft 3 upwardly (i.e. along arrow D in FIG. 6) thereby disconnecting the splines 71, 72 while the wave generators 52, 52*a* remain engaged with the flexible gear 53. The second way is illustrated in FIG. 7 and involves pushing the drive shaft 3 downwardly, i.e. compressing the back off sub 100 (arrow F in FIG. 7) thereby disconnecting the splines 71, 72, while the second wave generator 52*a* remains engaged with the flexible gear 53 and the first wave generator 52 becomes disengaged from the flexible gear 53.

Modifications and improvements are envisaged without departing from the scope of the present invention as defined in the appended claims.

The present invention may be also described as follow. A downhole workstring generally comprises fluid channel or bore extending from the top of the workstring through the bottom of the workstring. A fluid, generally a mud, is allowed to flow through the bore or fluid channel, for example for providing a stream of fluid between the workstring and the walls of the downhole, evacuating the cuttings during a drilling operation, or also for avoiding the drill bit to be stuck into the downhole and for reducting the drag while the workstring is rotating inside the downhole.

The tool of the present invention comprises a drive shaft (3), preferably tubular and forming a part of the bore of the workstring. The tool further comprises and a housing (21, 22), advantageously surrounding the drive shaft and couplable to said drive shaft (3). The housing comprises a first housing part (22) and a second housing part (21) releasably connected to one another.

The tool of the present invention is characterized in that it further comprises transmission means (wave generator 52, a flexible gear 53 and a circular (outer) gear 54) coupled to the drive shaft (3), said transmission means being arranged to selectively connect or disconnect the housing parts (21), (22) by rotating the drive shaft (3).

Preferably, the transmission means (wave generator 52, a flexible gear 53 and a circular (outer) gear 54) are arranged so that the rotation of said drive shaft (3) causes a longitudinal displacement of one of the housing parts (22), (21), or of an operating member (104) for connecting or disconnecting said housing parts, and so that the housing parts (22), (21) are connected or disconnected as a result of said axial displacement.

The tool comprises a kinematic pair which is selected such that said axial displacement occurs for a predetermined disconnection time before the housing parts disengage.

More preferably, the tool comprises a gear reduction mechanism, for example a harmonic drive or a planetary gear.

A preferred embodiment of the present invention is described by reference with the drawings 8*a*, 8*b*, 8*c*, 8*d* showing consecutive parts respectively from the top of the tool to the bottom of the tool. In an embodiment of the present invention, the housing comprises a first annular portion (106') extending inside the housing and preferably located near the top of the housing. The first annular portion (106') is hold by a second annular portion (106) fixed on the drive shaft (3). Preferably, thrust roller bearings (105) are inserted between the first annular portion (106') and the second annular portion (106). The gear reduction mechanism is arranged for selectively transmitting the torque of said drive shaft (3) to one of said housing parts (21, 125), said gear reduction mechanism comprising an output gear element (53) of which a threaded portion (108) is coupled to a threaded portion (107) of an operating member (104) for connecting or disconnecting said housing parts, such that rotational motion of the output gear element (53) results in axial displacement of said operating member (104).

Preferably, the gear reduction mechanism further comprises a reference gear element (54), which is fixed to or integrally formed with said housing part (21), an input gear element (127) fixed to said drive shaft (3), and an output gear element (53), such that rotation of the input gear element (127) relative to the reference gear element (54) results in rotation of the output gear element (53). In FIG. 8*b*, a part of the tool is represented with a harmonic drive. Advantageously, thrust roller bearings (109) are positioned between the output gear element (53) and the reference gear element (54) for facilitating the rotation of the output gear element (53).

Figure 8A:
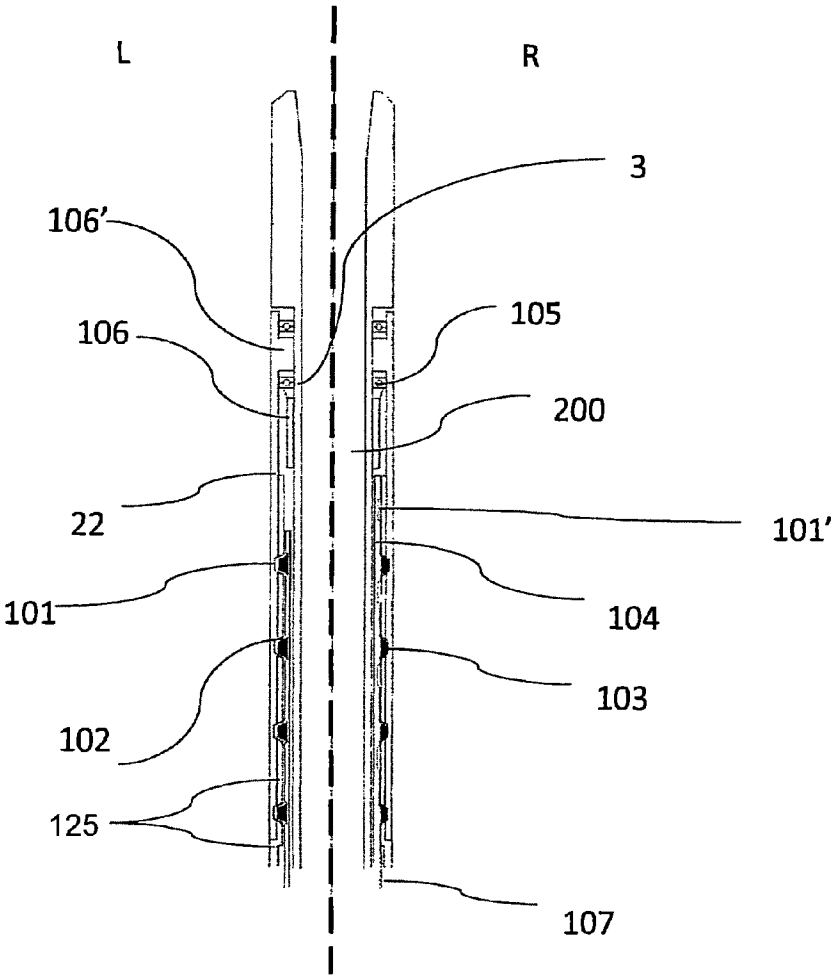
FIG. 8*a*, 8*b*, 8*c*, 8*d* show consecutive parts of a tool according to the present invention. Each of these
Figure 8B:
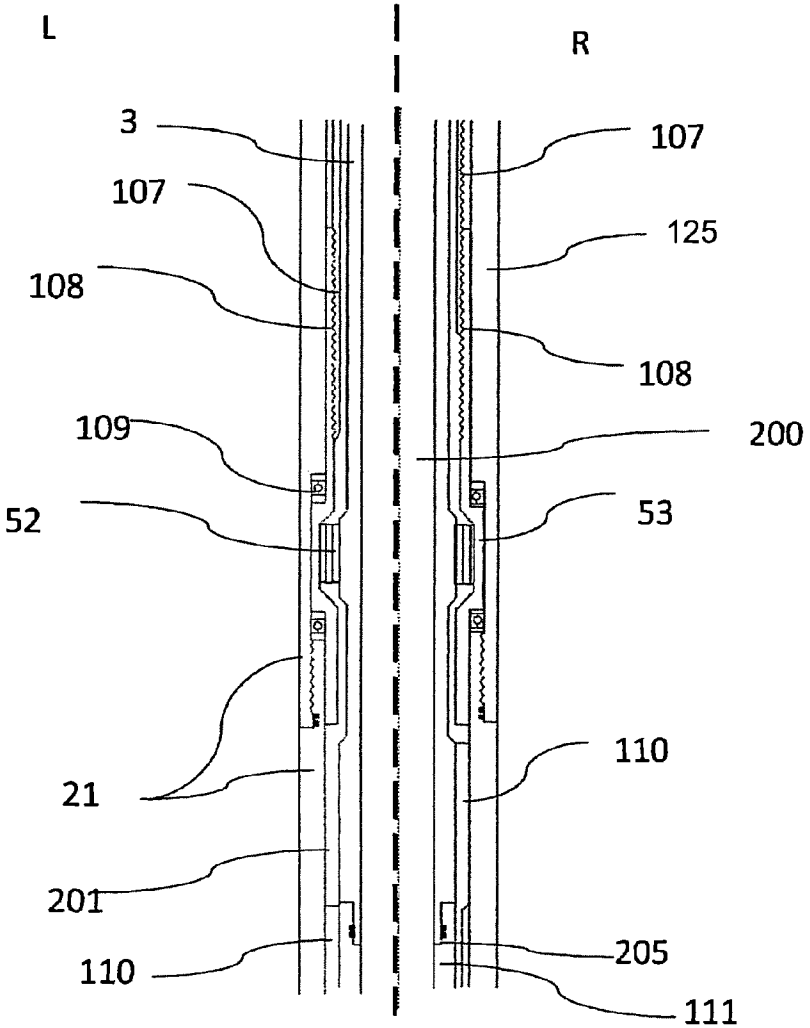

Preferably, as shown in FIG. 8*a*, the first (22) housing part comprises a first set of longitudinally spaced reception cavities (101), and the second housing part (21, 125) comprises a second set of longitudinally spaced reception cavities (102). When both housing parts (22), (21) are connected, they are in a relative position wherein the cavities (101) of the first set and the cavities (102) of the second set are aligned in transversal direction. The tool further comprises an operating member (104) comprising a third set of longitudinally spaced reception cavities (101') located on the operating member (104) such that they can be aligned with the first and second set of reception cavities (101, 102). The tool further comprises a number of movable connection elements (103), each connection element being associated with a respective pair of aligned cavities, and being selectively positionable in a first position wherein it extends in both aligned cavities (101),(102) of its associated pair, and a second position wherein it does not extend in both aligned cavities of said pair. The operating member (104) is longitudinally displaceable between:

- a holding position wherein the third set of reception cavities (101') are misaligned respect to the first and second set of reception cavities (101, 102) holding each connection member (103) in the first position, connecting the first housing with the second housing, and;
- a releasing position wherein the third set of reception cavities (101') are aligned at least with the second set of reception cavities, allowing the connection elements (103) to move out of the first set of reception cavities (101) and to move towards the third set of reception cavities (101'), disconnecting the first housing from the second housing.

Preferably, the reception cavities in the first housing part (22) are transversal recesses (101), the reception cavities in the second housing part (21, 125) are holes (102), the connection elements (103) are blocks fitting in a hole (102) and a recess (101) in alignment therewith, and the reception cavities of the operating member (104) are transversal recesses (101').

Such a connection means between the first and second housing parts (22, 21) has the advantage over threaded connections to be more resistant to failure when the housing parts are disconnected from each other.

As shown at the right side R of the FIG. 8*a*, when the first housing (22) is connected to the second housing (21), the recesses (101) of the first housing (22) are aligned with the holes (102) of the second housing (21) and misaligned respect to the recesses (101') of the operating member. The blocks (103) are maintained by the operating member inside both the holes (102) of the second housing (21) and the recesses of the first housing, insuring a connection between both housing parts. As shown at the left side L of the FIG. 8*b*, when the first housing (22) is disconnected from the second housing (21), the recesses (101') of the operating member are aligned with the holes (102)*of* the second housing part (21) and the recesses (101) of the first housing part (22). The blocks (103), the recesses (101) of the first housing part, the holes (102) of the second housing part (21) and the recesses (101') of the operating member (104) are designed such that:

- when the recesses (101') of the operating member (104) are aligned with the holes (102) of the second housing part (21), the blocks (103) can move out of the recesses (101) of the first housing part (22) towards the recesses (101') of the operating member (104), allowing the first housing part to move axially respect to the second housing part and;
- the blocks (103) are able to move through the hole (102) but are not able to move completely out of the hole (102).

Figure 9C:
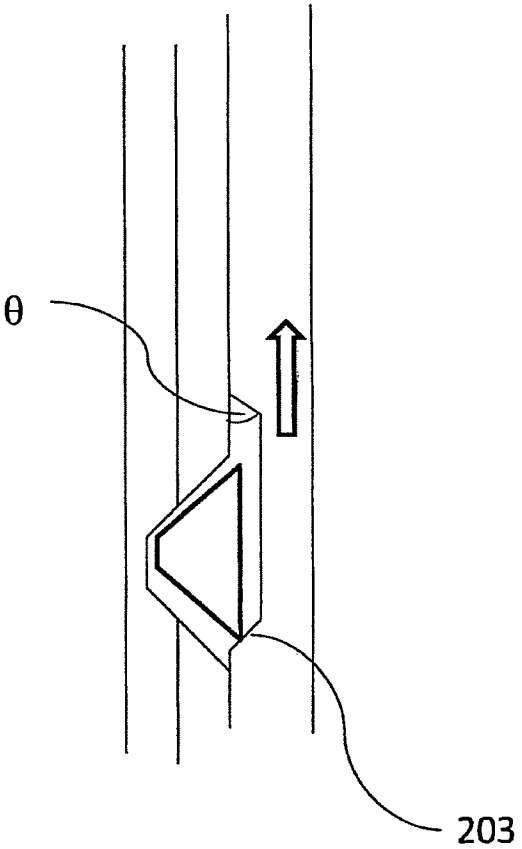
FIGS. 9*a*, 9*b* and 9*c* show an enlarged view of a connection means for connecting a first housing part and a second housing part of the tool according to an embodiment of the present invention, respectively in a connecting position, in a disconnecting position and in an intermediate position.
Figure 9B:
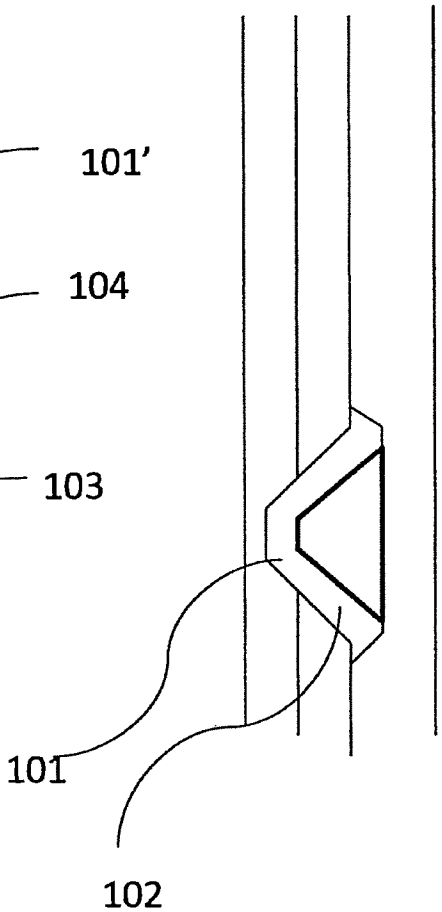
Figure 9A:
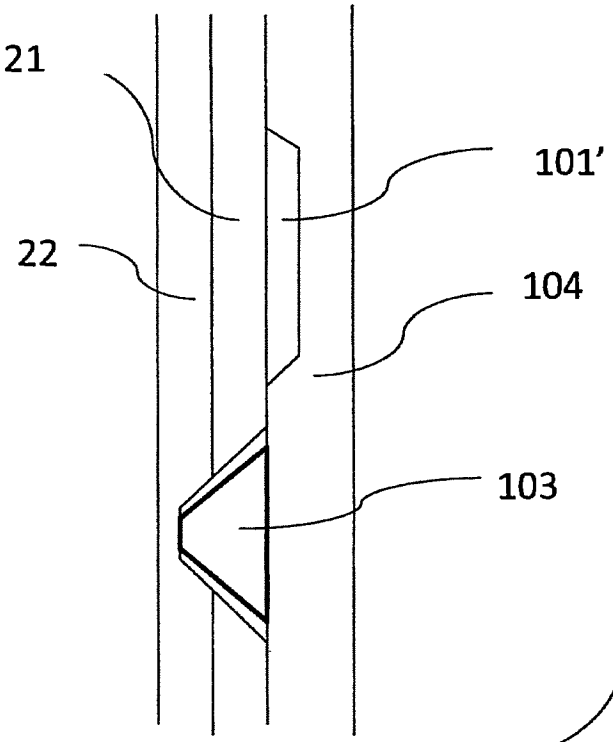

FIGS. 9*a*, 9*b* and 9*c*, show an enlarged view of the reception cavities of the first housing part, of the second housing part and of the operating member, respectively in a connecting position, in a disconnecting position and in an intermediate position. The blocks (103), the recesses (101) of the first housing (22), the holes (102) and the recesses (101') of the operating member (104) are designed such that:

- when the recesses (101) of the first housing (22), are aligned with the holes (102), the recesses (101) of the first housing preferably form with the holes (102) a trapezoidal or semi cylindrical or cross-section, and;
- the blocks (103) have substantially the same shape of the said cross-section, with a smaller size such that the blocks (103) are able to move through the holes (102) but are not permitted to move completely out of the holes (102).

The cross-section of recesses (101') of the operating member (104) preferably has a shape comprising an edge (203) forming an acute angle with the second housing (21) and oriented in a manner that when the operating member (104) is moved for connecting the first housing part (22) with the said second housing part (21), the edges push the blocks (103) towards the recesses (101) of the first housing (22), avoiding the stuck of the blocks (103) when the operating member (104) moves respect to the second housing (21).

Figure 8C:
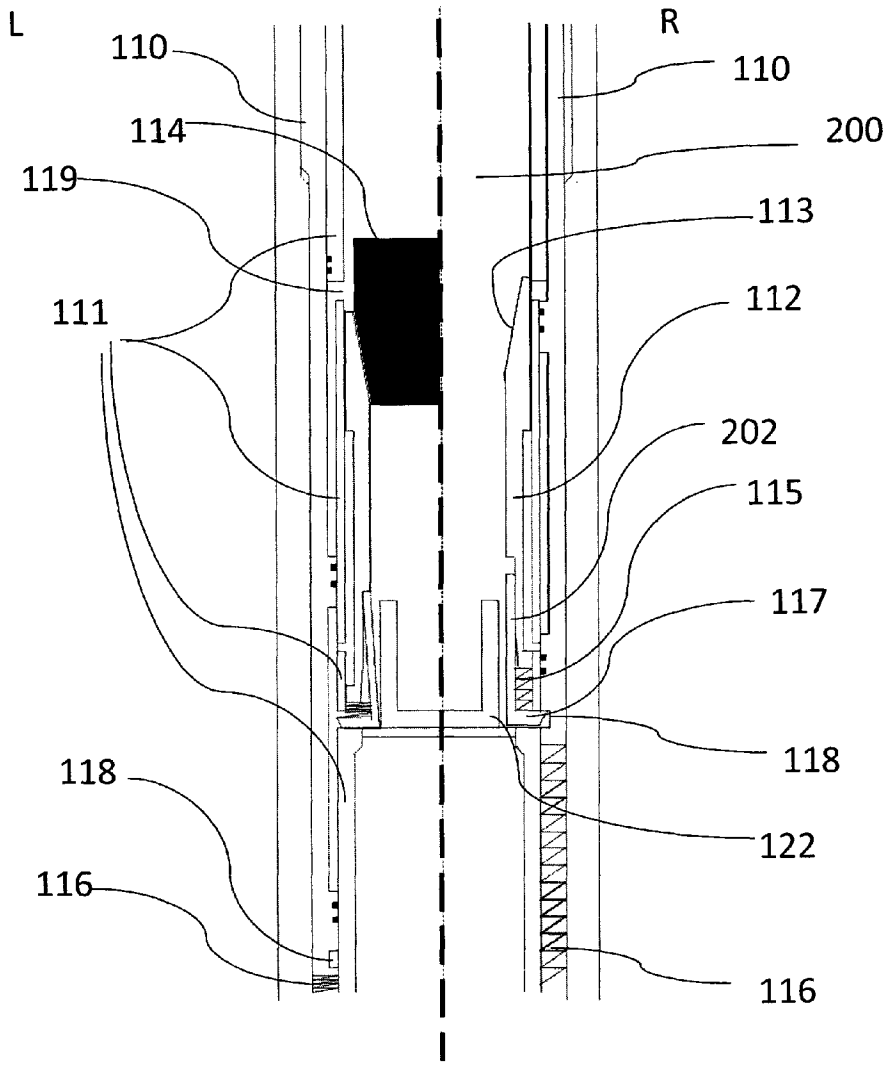

Preferably, the tool further comprises a coupling member (110) which is selectively displaceable between a coupling position as shown at the left part L of the FIG. 8*c* and an uncoupling position as shown at the right part R of the FIG. 8*c*, wherein the drive shaft (3) and one of the housing parts (21, 22) are coupled and uncoupled respectively. In an embodiment of the invention, when the coupling member (110) is in its coupling position, it couples the drive shaft (3) with the second housing part (21). The coupling member (110) comprises for example a set of splines (not represented for reason of clarity) matching with a set of splines comprised in the second housing part (21). Advantageously, the coupling member (110) surrounds the drive shaft (3) and comprises a portion having an internal polygonal bore matching with a portion of the drive shaft (3) comprising a polygonal cross section. In another embodiment of the invention, the spline coupling between the coupling member (110) and the second housing part (21) may be replaced by a polygonal coupling i.e. a coupling wherein the second housing part (21) comprises a portion having a polygonal bore matching with a portion of the coupling member (110) having a polygonal cross section.

Figure 8D:
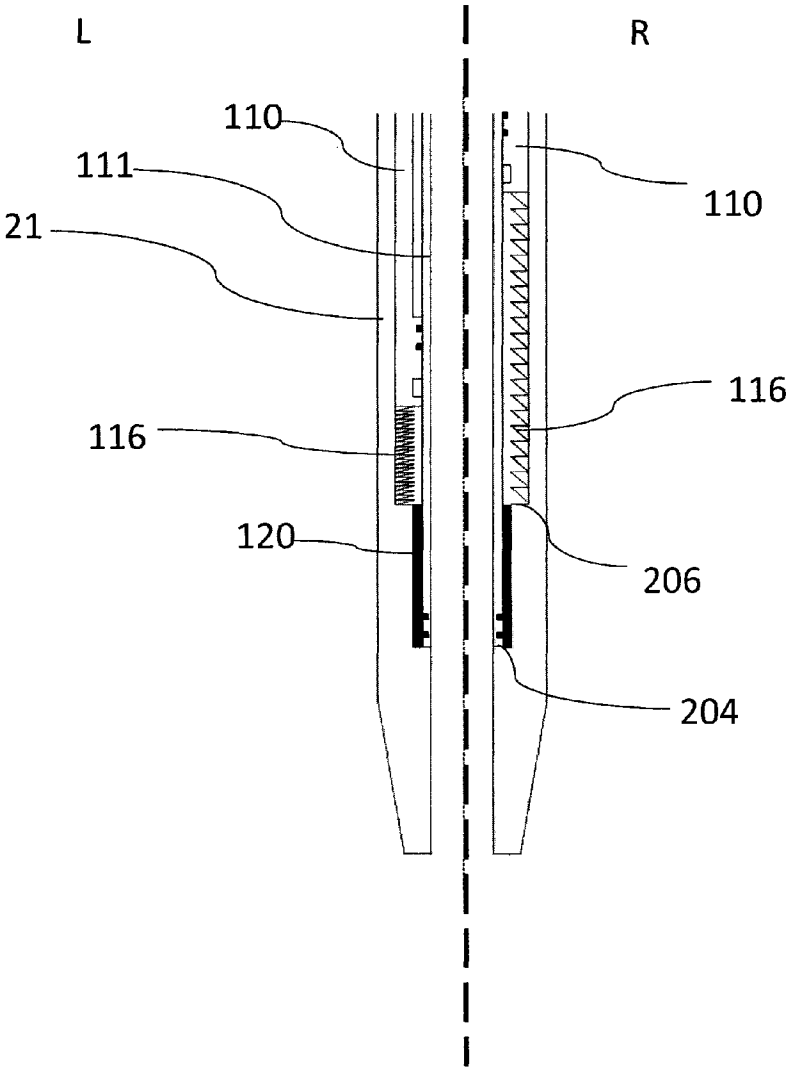

The coupling member (110) is displaceable in a space (201) which is in communication with a fluid channel (200) of the tool through at least one aperture or port (119). In an embodiment of the invention as shown in FIGS. 8*c* and 8*d*, the second housing part (21) comprises a first internal recess (204) wherein a tubular sleeve (111) is inserted. Advantageously, the tubular sleeve (111) comprises a recess (205) wherein the drive shaft (3) is tightly inserted. The tubular sleeve (111) may be coupled with the drive shaft and in that case a plane radial bearing (120) is inserted in the first internal recess (204) of the second housing part. The tubular sleeve (111) may also be not coupled to the drive shaft (3) in another embodiment. The second housing part (21) further comprises a second recess (206) forming the space (201) between the tubular sleeve (111) and the second housing part (21), the space (201) being in communication with the fluid channel (200) through the aperture or port (119) being formed in the wall of the tubular sleeve (111). The tool further comprises a spring member (116) urging the coupling member (110) towards its coupling position, and an operating assembly (112,114,115) for selectively opening or closing said aperture (119) so that:

- when the aperture (119) is open, a fluid flowing in the fluid channel (200) is allowed to enter the space (201) through said aperture (119), thereby exerting a force on said coupling member (110) resulting in its displacement into the uncoupling position, and,
- when the aperture (119) is closed, the coupling member (110) is moved into the coupling position by said spring member (116).

In an embodiment of the invention, as shown in the FIG. 8*c*, the operating assembly (112,114,115) comprises

- a sleeve or operating sleeve (112) located inside said fluid channel (200), said sleeve (112) being movable between a closing position wherein it closes said aperture or port (119) and an opening position wherein it leaves said aperture (119) open,
- an object (114) insertable in said fluid channel (200),
- a trap (113) for capturing and holding the object (114) in the channel (200),
- a spring element (115) urging the movable sleeve (112) towards its closing position, said operating assembly (112,114,115) being arranged so that, when a fluid is flowing in the fluid channel (200), the insertion of the object (114) and its resulting position in the trap (113) influences the fluid pressure in the channel (200) such that said sleeve (112) is moved into the opening position, and that, when the object (114) is not positioned in the trap (113), the sleeve (112) is moved into the closing position by said spring element (115).

Preferably, the tubular sleeve (111) comprises a support (122) that supports the operating assembly (112, 114, 115).

More preferably, the operating assembly further comprises a locking pin (117) that can move through a hole formed in the wall of the tubular sleeve (111) and selectively enter or move out of a recess (118) formed in the coupling member (110). Preferably, the locking pin is mounted on a lever ( ) comprised between the operating sleeve (112), the tubular sleeve (111) and the support (122) so that:

- when the operating sleeve (112) is in its closing position, the lever (202) is substantially parallel to the tubular sleeve (111) and the locking pin crosses the hole formed into the wall of the tubular sleeve to enter in the recess of the coupling member (110), thereby locking the coupling member (110) and;
- when the operating sleeve (112) is in its opening position, the lever is pushed by the operating sleeve (112) moving the locking pin (117) out of the recess (118) of the coupling member (110), thereby allowing the coupling member (110) to be pushed by the flowing fluid and decoupling the drive shaft (3) from the second housing (21).

In a preferred embodiment of the invention, the drive shaft (3) comprises an upper end fixed, preferably screw, to a bottom end of the upper work string, and the second housing comprise a lower end fixed, preferably screw, to the upper end of the lower work string or bottom hole assembly.

According to a second aspect of the invention, a method is provided for disconnecting an upper work string from a stuck lower workstring or a stuck bottom hole assembly of a work string, using the tool according to the embodiment of the FIGS. 8*a* to 8*d*.

When a lower work string or a bottom hole assembly (herein after called BHA) of a workstring is stuck in the down hole, a sensor detects the that the lower work string or BHA is stuck, the drilling operator assesses the situation and may take the decision to activate the disconnection of the lower work string or BHA. In that situation, the drilling operator throws an object (114) for example, a dart or a ball, into the fluid channel (200). The object (114) is dragged by the flow of the fluid flowing in the fluid channel until it is catch by the trap (113) comprised at the top of the operating sleeve (112). The operating sleeve (112), which is initially retained in its closing position by the spring element (115), is moved down to its opening position, wherein:

- the lever (202) is pushed by the operating sleeve (112), moving the locking pin (117) out of the recess (118) of the coupling member (110) and;
- the port or aperture (119) becomes open and allows the fluid flowing in the fluid channel ( ) to enter in the space ( ) through said aperture (119), thereby exerting a force on said coupling member (110) resulting in its displacement into the uncoupling position.

The drive shaft (3) is therefore uncoupled from the second housing part (21). Since the drive shaft (3) was coupled with the second housing (21) connected to the first housing, and since the stuck lower workstring or BHA is fixed to the second housing, the drive shaft (3) was not able to rotate inside the housing (21, 22) because the coupling member (110) was coupling the drive shaft (3) with the second housing part (21). When the coupling member (110) is in its uncoupling position, the drive shaft (3) is able to move again inside the housing (21, 22) independently from the second housing (21) that comprises the reference gear element (54). Therefore, the input gear element (127) rotates with the drive shaft (3) if a torque or a residual torque is applied on the drive shaft (3), and the rotation of the input gear element (127) respect to the reference gear element (54) results in a rotation of the output element (53) in the opposite direction of the drive shaft (3) and with a very low transmission ratio respect to the rotation of the drive shaft.

The rotation of the output gear element (53) results in an axial movement of the operating member (104) that allows the alignment of the recesses (101') of the operating members (104) with the holes (102) of the second housing (21) and the recesses (101) of the first housing (22), thereby allowing the first housing to move axially respect to the second housing when the upper workstring is pull off the downhole, the upper workstring being connected to the drive shaft that holds the first housing via the second annular portion fixed on the drive shaft (3).

The upper workstring can be connected or reconnected to the lower workstring or BHA by rotating the drive shaft in the appropriate direction for moving the operating sleeve (104) to its connecting position.

The man skilled in the art can also imagine a tool operating a disconnection of a first housing part from a second housing part with an axial movement of the drive shaft as presented in the embodiments related to the FIGS. 1 to 7, but wherein the threaded connection between the first housing part (22) and the second housing part (21) is replaced by a connection means such as presented in the embodiment related to the FIGS. 8*a* to 9.

The invention claimed is:

1. A tool for selectively connecting or disconnecting components of a downhole workstring, the tool comprising:

a drive shaft (3) and a housing (21,22) couplable to said drive shaft (3), said housing comprising a first housing part (22) and a second housing part (21) releasably connected to one another, wherein the tool further comprises transmission means (52-54) coupled to the drive shaft (3), said transmission means being arranged to selectively connect or disconnect the housing parts (21),(22) by rotating the drive shaft (3), wherein said transmission means (52-54) are arranged so that the rotation of said drive shaft (3) causes a longitudinal displacement of one of the housing parts (22), (2), or of an operating member (104) for connecting or disconnecting said housing parts, and that the housing parts (22), (21) are connected or disconnected as a result of said axial displacement, wherein the tool comprises co-operating threads (24) which are selected such that said axial displacement occurs for a predetermined disconnection time before the housing parts disengage, and wherein the tool comprises a gear reduction mechanism.

2. A tool as claimed claim 1 wherein said transmission means comprises a gear mechanism arranged for selectively transmitting the torque of said drive shaft (3) to one of said housing parts (21,54), said gear mechanism comprising an output gear element (53) of which a threaded portion (08) is coupled to a threaded portion (107) of an operating member (104) for connecting or disconnecting said housing parts, such that rotational motion of the output gear element (53) results in axial displacement of said operating member (104).

3. A tool according to claim 2 wherein said gear mechanism comprises a harmonic drive having a reference gear element (54), which is fixed to or integrally formed with said housing part (21), an input gear element (52) fixed to said drive shaft (3), and an output gear element (53), such that rotation of the input gear element (52) relative to the reference gear element (54) results in rotation of the output gear element (53).

4. A tool as claimed in claim 3, wherein the first (22) housing part (22) and the second housing part (21, 54) comprise a set of longitudinally spaced first reception cavities (102), and a set of longitudinally spaced second reception cavities (102) respectively, that the connected housing parts (22), (21) are in a relative position wherein the first cavities (101) and the second cavities (102) are aligned in transversal direction, and that the tool further comprises—a number of movable connection elements (103), each connection element being associated with a respective pair of aligned first (101) and second cavities (102), and being selectively positionable in a connecting position wherein the tool extends in both aligned cavities (101),(102) of its associated pair, thereby preventing relative longitudinal displacement of the housing elements, and a disconnecting position wherein the tool does not extend in both aligned cavities (101), (102) of said pair, and—an operating member (104) for selectively positioning said connection elements (103) in the connecting position or allowing the connection elements (103) to move or to be moved into the disconnecting position, so that the housing parts (22), (21) are connected or disconnected.

5. A tool as claimed in claim 4 wherein said operating member (104) is longitudinally displaceable between a holding position wherein the operating member is holding each connection member (103) in a respective connecting position, and a releasing position wherein the connection members (103) are allowed to move or to be moved into the disconnecting position.

6. A tool as claimed in claim 5 wherein the operating member (104) comprises a set of longitudinally spaced third reception cavities (101'), such that, when the operating member (104) is placed in the releasing position, each third cavity (101') is aligned with a respective pair of aligned first (10) and second cavities (102), and the connecting elements (103) are allowed to move or to be moved to a disconnecting position wherein they are removed from the first cavities and extending in the aligned second (102) and third cavities (101').

7. A tool as claimed in claim 6 wherein the first reception cavities are transversal recesses (101) in the first housing part (22), that the second reception cavities are holes (102) in the second housing part (21,54), that the connection elements (103) are blocks fitting in a respective alignment of a hole (102) and a recess (101), and that the third reception cavities are recesses (101') in the operating member (104).

8. A tool as claimed claim 7 wherein each pair of aligned first (101) and second reception cavities (102) define a reception space delimited by at least one inclined end surface, such that a connection element (103), when positioned in its connection position, is transversally moved towards its disconnection position, when a force acting in longitudinal direction pushes said connection element against said inclined surface, said force being the result of gravity and/or the result of a relative longitudinal displacement of the housing parts.

9. A tool according to claim 8 wherein the tool comprises a coupling member (110) which is selectively displaceable between a coupling position and an uncoupling position wherein the drive shaft (3) and one of the housing parts (21) are coupled and uncoupled respectively.

10. A tool as claimed in claim 9 wherein said coupling member (110) is displaceable in a space (201) which is in communication with a fluid channel (200) of the tool through at least one aperture (119), that the tool further comprises a spring member (116) urging the coupling member (110) towards its coupling position, and an operating assembly (112,114,116) for selectively opening or closing said aperture (9) so that, when the aperture (119) is open, a fluid flowing in the fluid channel (200) is allowed to enter the space (200) through said aperture (119), thereby exerting a force on said coupling member (110) resulting in its displacement into the uncoupling position, and that, when the aperture (119) is closed, the coupling member (110) is moved into the coupling position by said spring member (116).

11. A tool as claimed in claim 10 wherein said operating assembly (112,114,116) comprises a sleeve (2) located inside said fluid channel (200), said sleeve (112) being movable between a closing position wherein it closes said aperture (119) and an opening position wherein it leaves said aperture (119) open, an object (114) insertable in said fluid channel (200), a trap (113) for capturing and holding the object (114) in the channel (200), a spring element (115) urging the movable sleeve (112) towards its closing position, said operating assembly (112,114,116) being arranged so that, when a fluid is flowing in the fluid channel (200), the insertion of the object (114) and its resulting position in the trap (113) influences the fluid pressure in the channel (200) such that said sleeve (112) is moved into the opening position, and that, when the object (114) is not positioned in the trap (113), the sleeve (112) is moved into the closing position by said spring element (115).

12. A tool according to claim 11, wherein said housing parts are arranged to rotate relative to each other about a common rotation axis, the housing parts being engaged together via co-operating threads arranged to translate the relative rotation of the housing parts into longitudinal displacement of the housing parts relative to each other and relative to the common rotation axis, and that said transmission mechanism is arranged to selectively transmit the rotation of the drive shaft to at least one of the housing parts thereby inducing the relative rotation of the housing parts and the resulting relative longitudinal displacement of the housing parts.

13. A tool as claimed in claim 12, wherein the tool is configured such that one part of the housing remains stationary during the relative rotation and the other part of the housing rotates about the rotation axis.

14. A tool as claimed in claim 13, wherein the transmission mechanism includes a locking means for selectively locking or unlocking at least one housing part so as to restrict or permit rotation of the housing part with respect to the drive shaft (3), wherein the tool is arranged to operate in a locked mode, in which the locking means locks the at least one housing part to the drive shaft whereas the transmission mechanism is engaged, with the result that the housing parts are rotatable as a unit with the drive shaft, so that torque and rotation from the drive shaft can be transmitted to the relevant equipment of the workstring.

15. A tool as claimed in claim 14, wherein the transmission mechanism includes an interruption means for interrupting or engaging the transmission mechanism to respectively disable or enable the transmission from the drive shaft to the housing part through the transmission mechanism, wherein the tool is arranged to operate in a back off mode, in which the locking means is actuated and the housing part previously locked to the drive shaft becomes released therefrom, i.e. the housing part becomes unlocked for rotation relative to the other housing part, whereas the transmission mechanism remains engaged, so that torque and rotation from the drive shaft can be transmitted through the transmission mechanism to cause the relative rotation of the housing parts.

16. A tool as claimed in claim 15, wherein the co-operating threads and the transmission mechanism are mutually arranged so that in the back off mode, rotation of the drive shaft in one direction causes one housing part to move away and eventually disconnect from the other housing part and wherein rotation of the drive shaft in the opposite direction results in the reversal of the relative rotation of the housing parts, so that the housing parts move axially toward each other and reconnect.

17. A tool as claimed in claim 16, wherein the tool is arranged to operate in a re-connection mode, in which the locking means locks at least one housing part to the drive shaft whereas the transmission mechanism is interrupted with the result that the housing part locked to the drive shaft is rotatable as a unit with the drive shaft and rotation and torque are transmitted directly from the drive shaft to that housing part, one housing part remains stationary downhole whereas the other part of the housing is rotatable directly by the drive shaft, wherein the relative rotation of the housing parts becomes converted into the relative axial movement of the housing parts by the co-operating threads.

18. A tool as claimed in claim 17, wherein the transmission mechanism comprises a harmonic drive comprising a wave generator, a flexible gear and an outer gear, wherein one of the wave generator, flexible gear and outer gear serves as a rotary input component and another of the wave generator, flexible gear and outer gear serves as a rotary output component; and wherein the harmonic drive is couplable with the drive shaft so that rotation of the drive shaft results in the relative rotation of the housing parts.

19. A tool as claimed in claim 18, wherein the wave generator of the harmonic drive is coupled to the drive shaft and thus serves as the rotary input component and the flexible gear and the outer gear are each coupled to one of the housing parts and one of the flexible gear or the outer gear serves as a the rotary output component so that the harmonic drive operates as a reducer and torque multiplier.

20. A tool as claimed in claim 19, wherein the wave generator of the harmonic drive is coupled to the drive shaft, the outer gear is coupled the housing part which remains stationary during relative rotation and the flexible gear serves as the rotary output component and is coupled to the part of the housing which rotates about the rotation axis relative to the stationary part of the housing, whereby the drive shaft and the flexible gear rotate in opposite directions.

21. A tool as claimed in claim 20, wherein the co-operating threads and/or the transmission mechanism are adjustable so that the relative axial displacement of the housing parts occurs for a required disconnection time before the housing parts disengage.

22. A tool as claimed in claim 21 wherein the interruption means is provided by arranging the wave generator and the flexible gear to be movable axially relative to each other so as to engage or disengage.

23. A tool as claimed in claim 22, wherein the flexible gear includes a flared mouth opening section for receiving and guiding the wave generator into engagement with the flexible gear, that the flared mouth opening section is configured so that the wave generator is disengaged from the flexible gear when positioned within the flared mouth opening section.

24. A tool as claimed in claim 23, wherein the locking means comprises an actuation mechanism adapted to switch the locking means between locked and unlocked modes, the actuation mechanism being actuatable upon a condition indicating that equipment of the workstring has become stationary and causing the locking mechanism to unlock.

25. A tool according to claim 24 wherein the first housing part (22) is connected to an upper workstring, and that the second housing part (21) is connected to a lower workstring or a bottom hole assembly.

26. A tool according to claim 25 wherein the tool further comprises means for detecting that the second housing part has become stationary.

27. A downhole workstring wherein the downhole workstring comprises a tool for selectively connecting or disconnecting components of said workstring, according to claim 26.

28. Method for disconnecting an upper workstring from a stuck lower workstring or a stuck bottom hole assembly of a workstring, wherein a tool according to claim 27 is used.

* * * * *